US006561511B1

(12) United States Patent
Vaysberg et al.

(10) Patent No.: US 6,561,511 B1
(45) Date of Patent: May 13, 2003

(54) MAGNETIC TABLE GAME

(76) Inventors: Tsaliy I. Vaysberg, 219 Laurel Rd. Apartment 408, Voorhees, NJ (US) 08043; Boris Solovey, 3005 Chapel Ave. West, Apartment 6-B, Cherry Hill, NJ (US) 08002

( * ) Notice: Subject to any disclaimer, the term of this patent is extended or adjusted under 35 U.S.C. 154(b) by 0 days.

(21) Appl. No.: 09/696,877

(22) Filed: Oct. 26, 2000

Related U.S. Application Data

(60) Provisional application No. 60/162,745, filed on Oct. 30, 1999.

(51) Int. Cl.[7] ..... A63F 7/06

(52) U.S. Cl. ..... 273/108.56; 273/126 A; 273/456; 273/443

(58) Field of Search ..... 273/108.51, 108.55, 273/108.56, 118 A, 126 A, 443, 126 R, 108.53, 119 R, 129 W, 108.1, 108, 456

(56) References Cited

U.S. PATENT DOCUMENTS 2,716,028 A * 8/1955 Yaeger
3,091,459 A * 5/1963 Lindman
3,105,687 A * 10/1963 Munro
3,741,541 A * 6/1973 Crismani
3,782,726 A 1/1974 Huffman et al.
3,946,520 A * 3/1976 Goldfarb
4,311,309 A * 1/1982 Bradley
4,834,371 A * 5/1989 Hay
5,332,215 A 7/1994 Gonzales

FOREIGN PATENT DOCUMENTS

FR 1144513 * 10/1957 ..... 273/85 F
FR 1.229.085 * 9/1960 ..... 273/85 F

* cited by examiner

*Primary Examiner*—Sebastiano Passaniti
(74) *Attorney, Agent, or Firm*—Akin, Gump, Strauss, Hauer & Feld, L.L.P.

(57) ABSTRACT

A table game includes a generally planar panel having a top surface including a playing field. First and second playing pieces are slidably positioned on the playing field. First and second control members are located below the panel with the first control member being magnetically coupled with only the first playing piece and with the second control member being magnetically coupled with only the second playing piece The first and the second control members are capable of moving the first and the second playing pieces respectively to substantially any location on the playing field without mutual interference between the first and the second control members.

12 Claims, 23 Drawing Sheets

MAGNETIC TABLE GAME

CROSS-REFERENCE TO RELATED APPLICATIONS

This patent application claims the benefit of U.S. Provisional Patent Application No. 60/162,745 filed Oct. 30, 1999, entitled Magnetic Hockey Game Apparatus.

BACKGROUND OF THE INVENTION

The present invention relates to a table game and more particularly to a table game employing permanent magnets for maneuvering playing pieces on the playing field of the table game.

Table games are generally known in which players maneuver opposing teams of playing pieces around a playing field with control members to play, for example, soccer, hockey and football. The aforementioned table games generally have a space underneath the playing field for accommodating the control members and a plurality of slots in the playing field through which a portion of each control member extends to connect with the respective playing piece. In this manner the playing pieces may be maneuvered around the playing field by maneuvering the control members underneath the playing field, thus the maneuvering of the control members does not directly interfere with the movements of the playing members.

However, with the aforementioned type of table game, the playing pieces are restricted to moving within the slots in the playing field, thus limiting interaction between the opposing playing pieces, restricting multiple playing pieces from being in a common area and generally preventing the playing pieces from being optimally positioned for manipulating a puck, ball etc.

Table games are also known which employ magnetic coupling between the control members located underneath the playing field, and the playing pieces. However, while known magnetic table games eliminate a need for slots in the playing surface, the motion of the playing pieces is also restricted because of interference between the control members of the opposing teams. Also, in the known magnetic table games it is not possible to rotate the playing members on their axes by manipulating the control members thus further restricting the maneuvering of the playing pieces.

Accordingly, it would be desirable to have a table game in which the playing pieces could be moved around the playing field without limitation as to location and without interference between the control members of the opposing teams, and also to have the capability to rotate the playing members on their axes.

BRIEF SUMMARY OF THE INVENTION

Briefly stated, the present invention is a table game comprising a generally planar panel having a top surface including a playing field. First and second playing pieces are slidably positioned on the playing field. First and second control members are located below the panel with the first control member being magnetically coupled with only the first playing piece and with the second control member being magnetically coupled with only the second playing piece. The first and the second control members are capable of moving the first and the second playing pieces respectively to substantially any location on the playing field without mutual interference of the first and the second control members.

In another aspect, the present invention is directed to a table game for maneuvering at least one first playing piece and at least one second playing piece on a playing field. The table game comprises a generally planar panel having a top surface including the playing field. A support structure supports the panel. The support structure includes a first channel below and adjacent to the panel and a second channel below and adjacent to the first channel. At least one first control member is slidably located within the first channel of the support structure, wherein the at least one first control member is magnetically coupled to the at least one first playing piece for maneuvering the at least one first playing piece around the playing field. At least one second control member is slidably located within the second channel of the support structure. The at least one second control member is magnetically coupled the at least one second playing piece for maneuvering the at least one second playing piece around the playing field. The at least one first control member is ineffective for maneuvering the at least one second playing piece when the at least one second playing piece is magnetically coupled to the at least one second control member, and the at least one second control member is ineffective for maneuvering the at least one first playing piece when the at least one first playing piece is magnetically coupled to the at least one first control member.

In a further aspect, the present invention is directed to a table game for maneuvering a playing piece slidably situated on a playing field. The table game includes a generally planar panel having a top surface, including the playing field. The table game also includes a control member having a control plate situated in a channel below the panel. The control plate is rotatable about a control axis generally perpendicular to a plane of the panel and is capable of a transverse movement to substantially any location in the channel below the panel. The control plate is magnetically coupled to the playing piece for maneuvering the playing piece on the playing field to substantially any location on the playing field and to rotate the playing piece about a vertical axis of the playing piece in correspondence to the transverse movement of the control plate and the rotation of the control plate.

BRIEF DESCRIPTION OF THE SEVERAL VIEWS OF THE DRAWINGS

The foregoing summary as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE PREFERRED EMBODIMENTS

Figure 1:
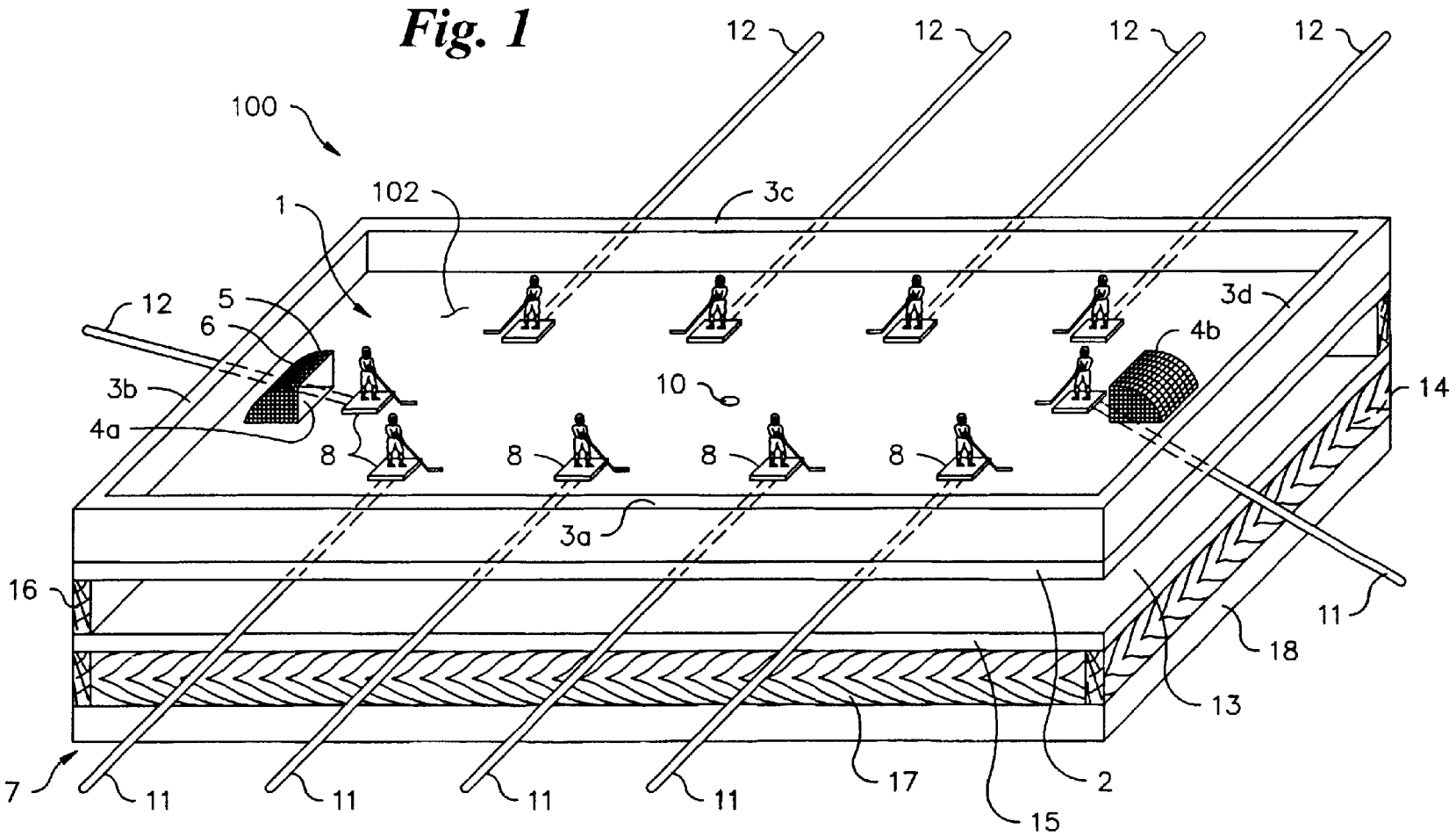
FIG. 1 is a perspective view of a first preferred embodiment of a table game as viewed from a first side showing a first channel.
Figure 2:
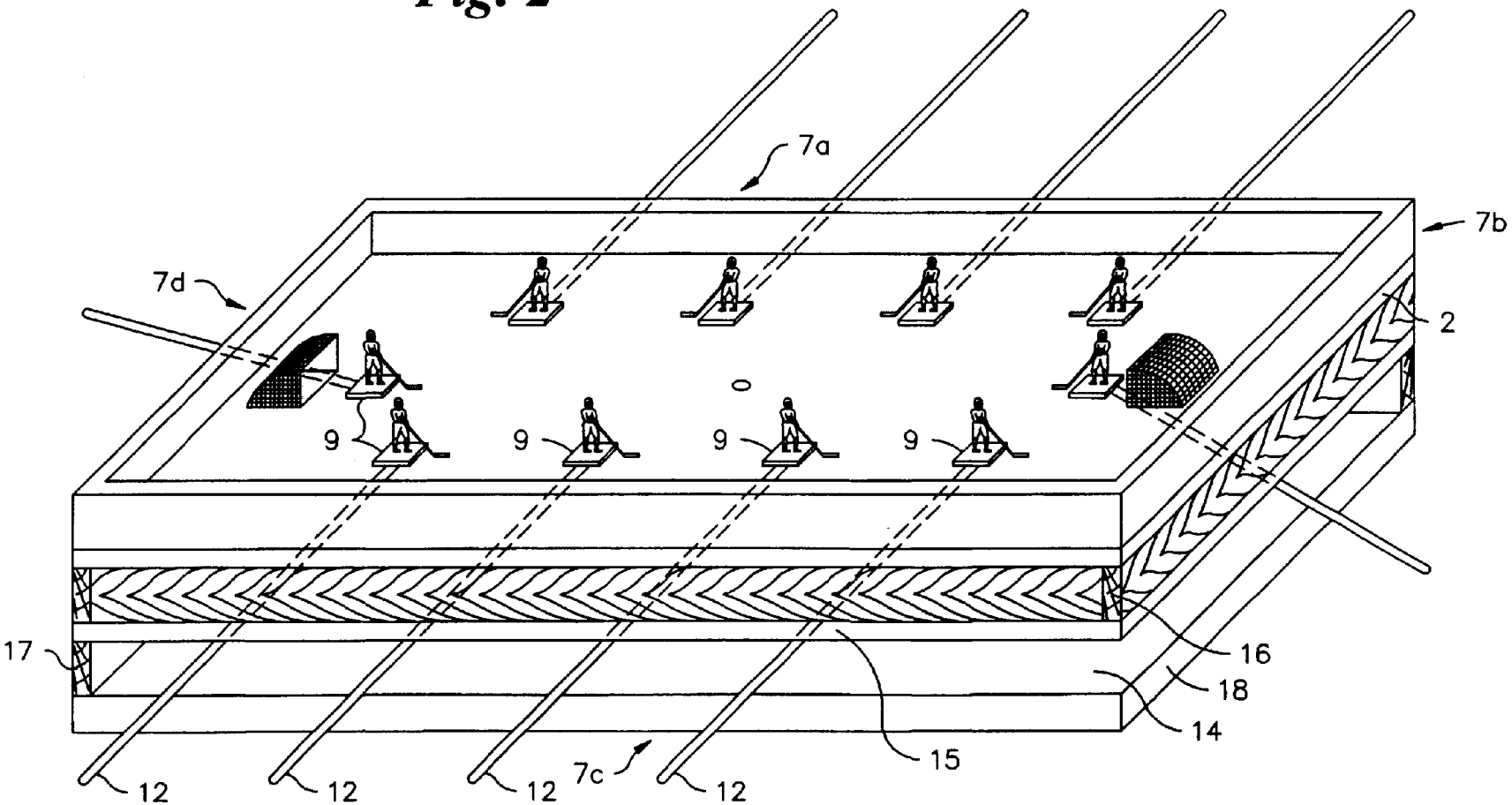
FIG. 2 is a perspective view of the first preferred embodiment of the table game as viewed from a second side opposite to the first side, showing a second channel.

Referring to the drawings, wherein like numerals are used to indicate like elements throughout the several figures and the use of the indefinite article "a" may indicate a quantity of one or more than one of an element, there is shown in FIGS. 1 and 2 a first preferred embodiment of a table game 100 for playing hockey comprising a playing field 1 located on a top surface 102 of a relatively thin, substantially planar first panel 2. The panel 2 is preferably constructed of a non-magnetic material such as a wood-based material, a polymeric material or aluminum coated with low coefficient of friction material such as a polymeric material or Teflon™. While the first preferred embodiment of the table game 100 implements a hockey game, it should be understood that the table game 100 is not limited to hockey. Other games, such as soccer, football and the like, are contemplated to be within the spirit and scope of the invention.

A support structure 7 made of a non-magnetic material supports the first panel 2. The support structure includes a first channel 13 below and adjacent to the first panel 2 and a second channel 14 below and adjacent to the first channel 13. The second channel 14 is separated from the first channel 13 by a thin, substantially planar non-magnetic second panel 15. The first channel 13 is formed by an L shaped first support member 16 located between the first panel 2 and the second panel 15. The height of the first channel 13, in which one or more first control members 11 are inserted is preferably of a minimum height, sufficient only to accommodate the first control members 11. The second channel 14 is formed by a second L-shaped support member 17 located between the second panel 15 and a base 18 of the table game 100.

The one or more first control members 11 are slidably located within the first channel 13 of the support structure 7. Each of the one or more first control members 11 is magnetically coupled to a first playing piece 8 positioned on the playing field 1, for maneuvering the first playing piece 8 to substantially any location of the playing field 1. One or more second control members 12 are slidably located within the second channel 14 of the support structure 7. Each of the one or more second control members 12 is magnetically coupled to a second playing piece 9 for maneuvering the second playing piece 9 to substantially any location around the playing field 1. Since the first control members 11 and the second control members 12 are located in separate channels 13, 14 having player access on opposite lateral sides of the game table 100, the first playing pieces 8 and the second playing pieces 9 can be moved to substantially any location on the playing field 1 without mutual interference between any of the one or more first control members 11 and any of the one or more second control members 12.

The design of the magnetic field of each one of the one or more first control members 11 is such as to make any one of the one or more first control members 11 ineffective for maneuvering a second playing piece 9 when the second playing piece 9 is magnetically coupled to one of the one or more second control members 12. Also, for the same reason, any one of the one or more second control members 12 are ineffective for maneuvering a first playing piece 8 when the first playing piece 8 is magnetically coupled to one of the one or more the first control members 11.

The structure 7 comprises a first side 7*a*, a second side 7*c*, a first end 7*b* and a second end 7*d*. The structure 7 also includes a wall 3 comprising a first sidewall 3*a*, a second sidewall 3*c*, a first endwall 3*b* and a second endwall 3*d* surrounding the playing field 1. The wall 3 is preferably constructed from any of a variety of hard woods, but any non-magnetic material with a coefficient of restitution approaching one can be used. The first preferred embodiment of the table game 100 is rectangular with dimensions of 6 feet in length by 3 feet in width. However, as would be appreciated by those skilled in the art, the table game 100 may be either larger or smaller than six feet by three feet. Further the table game 100, could be any other shape suitable for a particular game, for example oval, and still be considered within the spirit and scope of the invention. In addition, the game could be constructed for being supported on a separate support surface such as a table, or could be free standing with legs.

Two goals 4*a*, 4*b* are preferably located on the playing field 1 at some distance from the respective endwalls 3*b*, 3*d*. The goals 4*a*, 4*b* each include a frame 5 which supports a net 6 of a suitable flexible natural or synthetic material. The net 6 is attached to the frame 5 of each goal 4*a*, 4*b*, such that the front side of each goal 4*a*, 4*b* is open to receive a puck 10. The frame 5 may be constructed from any non-magnetic material capable of supporting the net 6 and withstanding the force of collisions with the puck 10 or a player 8, 9.

The first channel 13 has a first opening around the first side 7*a* and the second end 7*d* of the structure 7 such that a portion of each of the first control members 11 extends through the first opening allowing a first player to manipulate the first control members 11. Similarly, the second channel 14 has a second opening around a second side 7*c* and a first end 7*b* of the structure 7 such that a portion of each of the second control members 12 extends through the second opening allowing a second player to manipulate the second control members 12. The first panel 2 is installed generally perpendicular to the first support member 16 at the first end 7*b* and the second side 7*c*. There is no first support structure 16 along the first side 7*a* and the second end 7*d*. Because the first panel 2 is attached to the wall 3 along the entire perimeter of the first panel 2, the first panel 2 maintains its rigidity. The second panel 15 is installed perpendicular to the second support member 17 around the first side 7*a* and the second end 7*d* as shown in FIG. 1. The support member 17 is installed perpendicular to the non-magnetic, substantially planar base 18. The base 18 is constructed to have sufficient rigidity to ensure the rigidity of the entire table game 100.

The first preferred embodiment of the table game 100 further comprises one or more first playing pieces 8 belonging to a first team and one or more second playing pieces 9 belonging to a second team. In play, the playing pieces 8, 9 are situated on the playing field 1. The playing pieces 8, 9 are moved around the playing field by manipulation of the first and the second control members 11, 12, magnetically coupled respectively with the playing pieces 8, 9 as described below. In play, the puck 10, placed on the top surface 102 of the first panel 2, is propelled by the first and the second playing pieces 8, 9. The puck 10 is preferably constructed from a non-magnetic material. Preferably, the puck 10 has a coefficient of restitution approaching one and a low coefficient of friction.

Figure 3B:
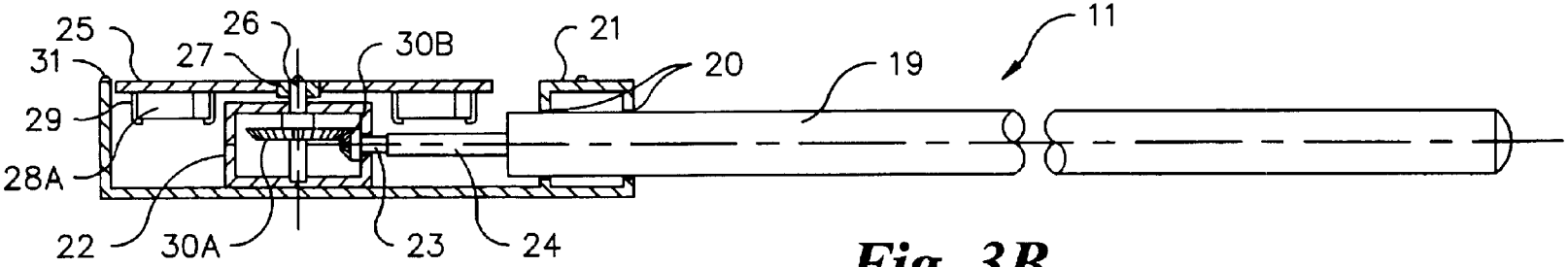
FIG. 3B is a sectional elevational view of the preferred embodiment of the first control member shown in FIG. 3A taken along the line 3B—3B.
Figure 3A:
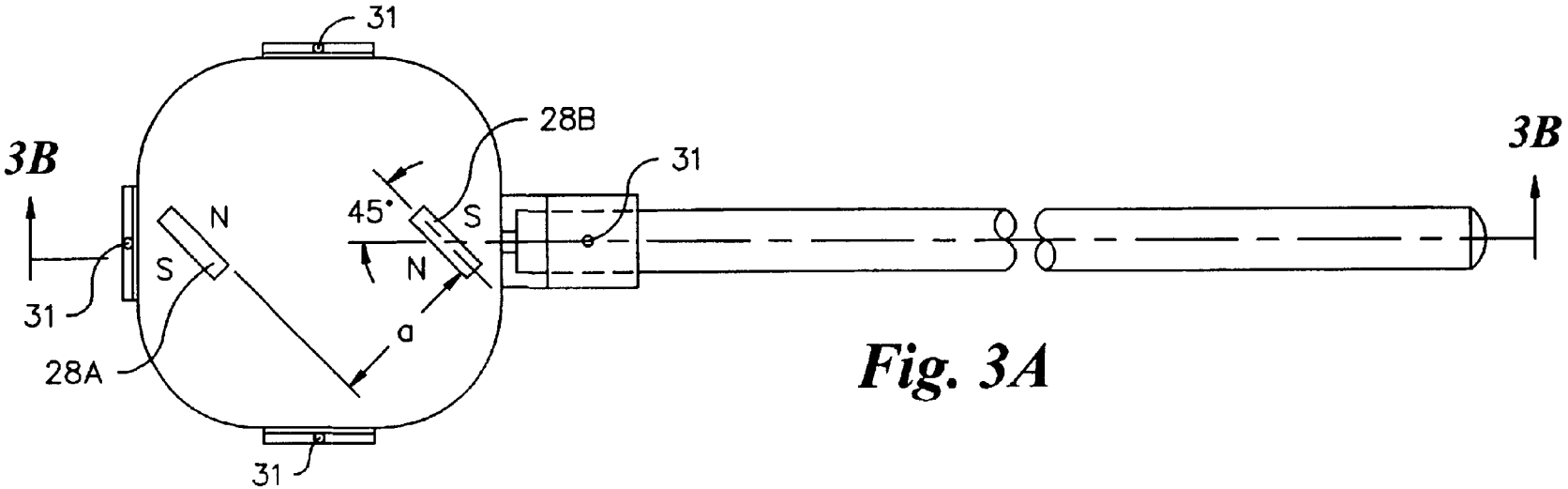
FIG. 3A is a top plan view of a preferred embodiment of a first control member showing a preferred configuration of first control magnets.

A first control member 11 is illustrated in FIGS. 3A and 3B. The first control member 11 includes a thin aluminum or polymeric first control plate 25 which is capable of being rotated about a control axis which is generally perpendicular to the panel 2 when the first control member 11 is located in the first channel 13. The first control member 11 is also capable of a transverse movement to substantially any location within the first channel 13. The first control plate 25 is magnetically coupled to a first playing piece 8 for maneuvering the first playing piece 8 to substantially any location on the playing field 1 and for rotating the playing piece 8 about a vertical axis of the playing piece 8 in correspondence to the transverse movement and the rotation of the first control plate 25.

The first control member 11 has a first control shaft 19, preferably of a length approximately equal to the length of the sides 7*a*, 7*c*. The first control shaft 19 is installed through first holes 20 into a first housing 21. A first transmission 22 connects the control shaft 19 to the first control plate 25 for transmitting a rotation of the first control shaft 19 about an axis of the first control shaft 19 to the first control plate 25. The first transmission 22 includes a first output bevel gear 30*a*, attached to a first output shaft 26 which is fixed to a first insert 27 in the first control plate 25. A first input bevel gear 30*b* with a first input shaft 23 is connected to the first control shaft 19 by a first flexible shaft 24. The axis of the first output shaft 26 is perpendicular to the axis of the first input shaft 23. Consequently, a rotation of the control shaft 19 rotates the first control plate 25 around the axis of the first output shaft 26 and perpendicular to the axis of the input shaft 23. As would be appreciated by one skilled in the art, the transmission 22 may be implemented by other means than a gear assembly of the type disclosed. Any transmission of small size that has an output shaft perpendicular to the input shaft could be used, within the spirit and scope of the invention.

An assembly of first control magnets 28*a*, 28*b* is attached to the first control plate 25 by first springs 29. The first control magnets 28*a*, 28*b* are mounted such that the direction of magnetization of the first control magnets 28*a*, 28*b* is parallel to a plane of the control plate 25, with like poles of the first control magnets 28*a*, 28*b* facing each other. The first control magnets 28*a*, 28*b* are offset approximately 45 degrees from the axis of the control shaft 19 to increase the torque for propelling the puck 10. In the preferred embodiment, the distance between the first control magnets 28*a*, 28*b* is about 1.5 inches, depending on the dimensions of the transmission 22, thereby permitting rotation of the first control magnets 28*a*, 28*b* around the transmission.

In the first preferred embodiment, the first control magnets 28*a*, 28*b* are preferably made of neodymium-iron-boron because the stored energy per unit volume of this material is one of the highest available. However, as would be known by those skilled in the art, almost any type of permanent magnet material could be used. For instance, the magnets could be made of samarium cobalt, barium ferrite or Alnico, or could be ceramic magnets, within the spirit and scope of the invention.

Preferably there are four small half-spheres 31 on the upper surface of the first housing 21. The diameter of each half-sphere 31 is preferably about 0.05 inches so that the clearance between the first magnets 28*a*, 28*b* and a bottom surface of the panel 2 (not shown) is minimal. The half-spheres 31 are preferably made of a material with a small coefficient of friction such as Teflon™, in order to decrease the friction between the first housing 21 and the bottom surface of the first panel 2. However, as would be appreciated by those skilled in the art the half-spheres 31 could be replaced, for instance, with a flat polymeric configuration or a small ball housed within a shaft, and still be within the spirit and scope of the invention.

Figure 3D:
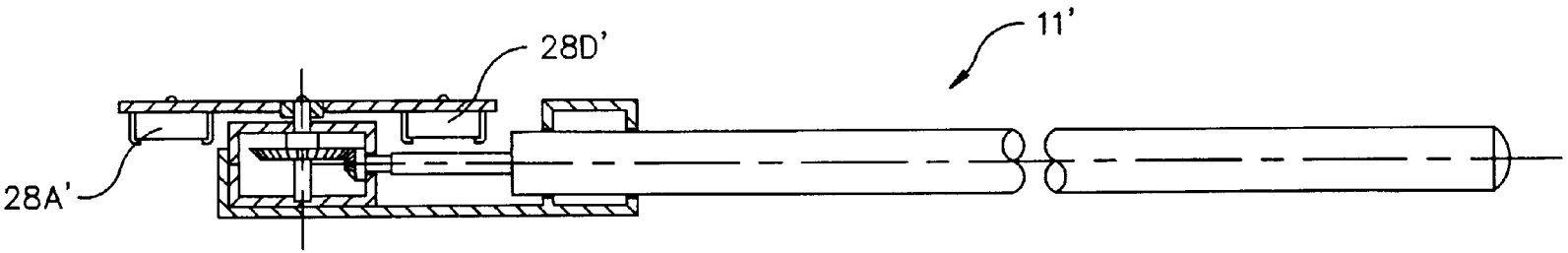
FIG. 3D is a sectional elevational view of the alternate embodiment of the first control member shown in FIG. 3C taken along the line 3D—3D.
Figure 3C:
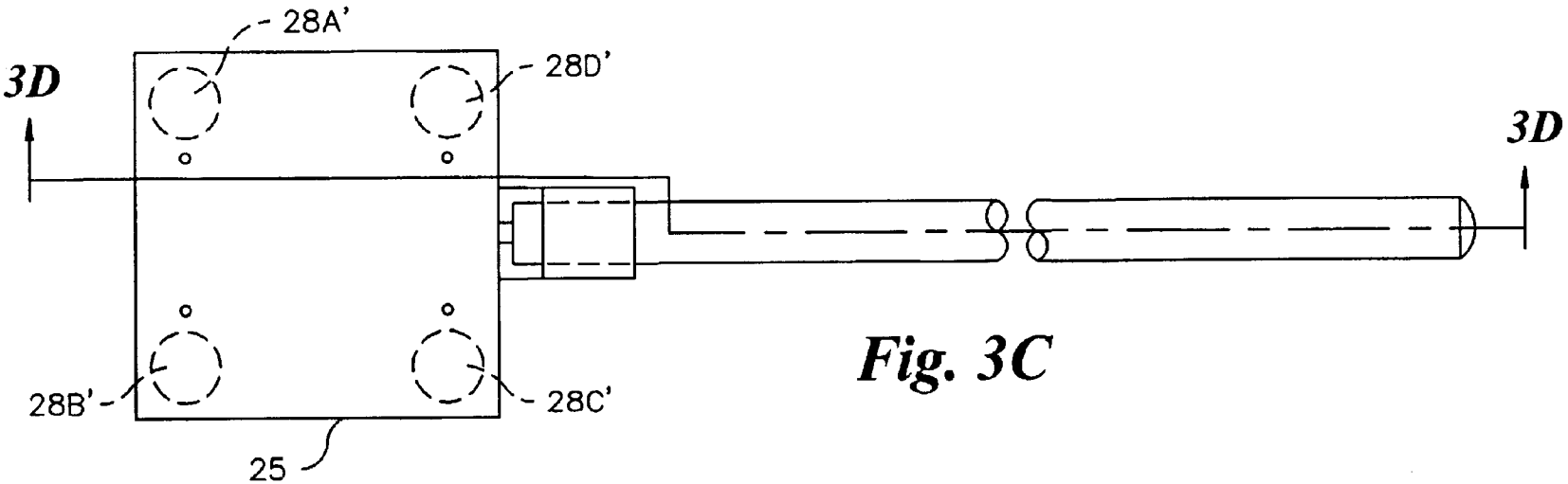
FIG. 3C is a plan view of an alternate embodiment of the first control member showing a first alternate configuration of the first control magnets.
Figure 3E:
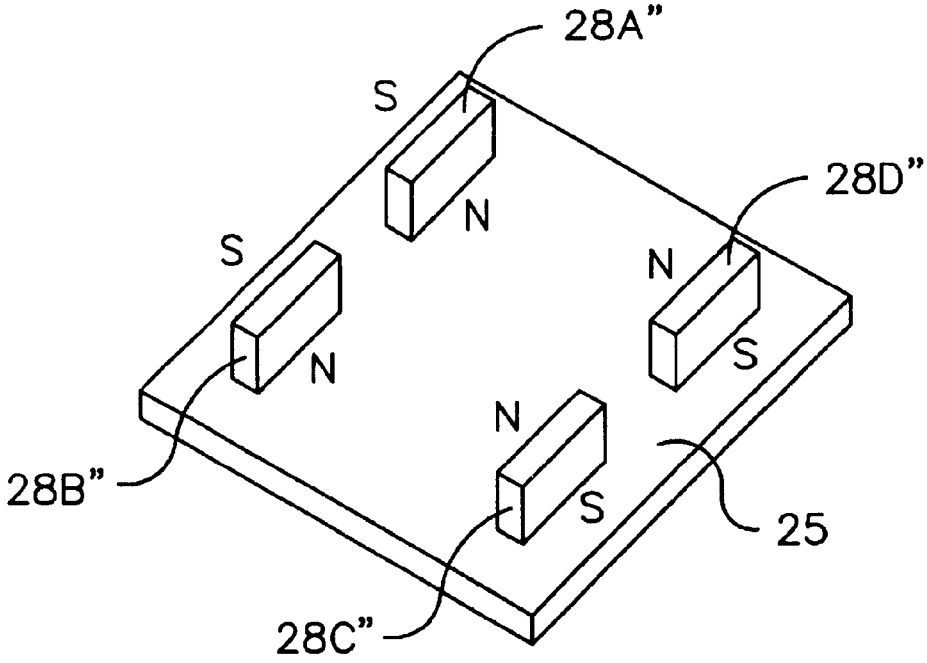
FIG. 3E is a perspective view of a second alternate configuration of the first control magnets.

FIGS. 3C and 3D show an alternate embodiment of a first control member 11' having a first alternate configuration of first control magnets 28*a*', 28*b*' 28*c*' and 28*d*'. The first alternate configuration of the magnets 28*a*', 28*b* 28*c*' and 28*d*' is arranged as if forming a rectangle. The direction of magnetization for each of the first control of magnets 28*a*', 28*b*', 28*c*' and 28*d*' is perpendicular to the plane of the control plate 25. The distance between the alternate first control magnets 28*a*', 28*b*', 28*c*' and 28*d*' is about 1.5 inches, permitting rotation of the magnets 28*a*', 28*b*', 28*c*' and 28*d*' around the transmission 22. Such a configuration of first control magnets 28 decreases the height of the control member 11 and provides for transmission of rotational motion from a player to the playing piece 8 with a maximum torque. FIG. 3E shows a second alternate configuration of the first control magnets 28*a*", 28*b*", 28*c*" 28*d*" mounted on the first control plate 25 and having a direction of magnetization for each magnet parallel to a first control plate 25.

Figure 4B:
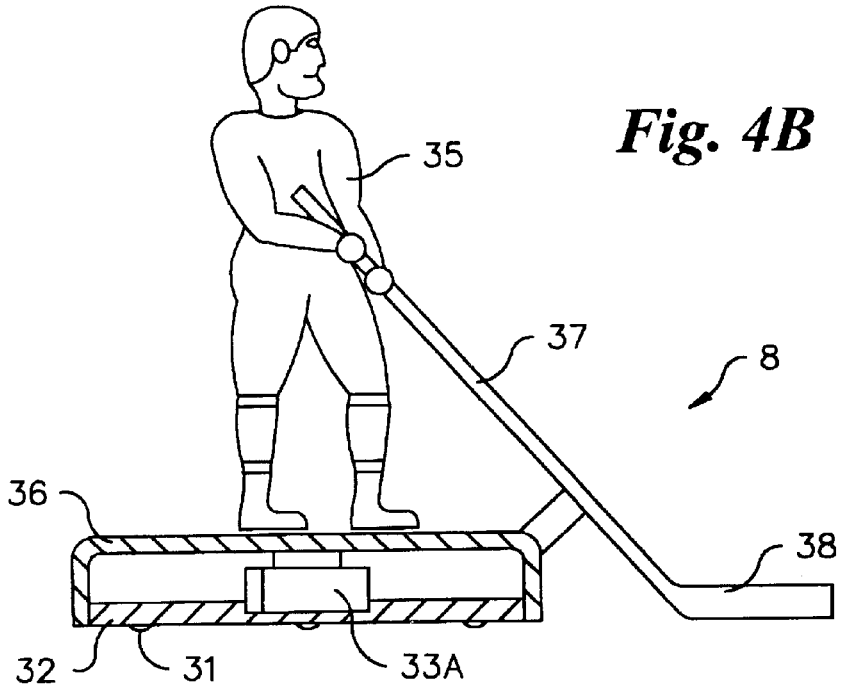
FIG. 4B is a sectional elevational view of the preferred embodiment of the first playing piece shown in FIG. 4A taken along the line 4B—4B.
Figure 4A:
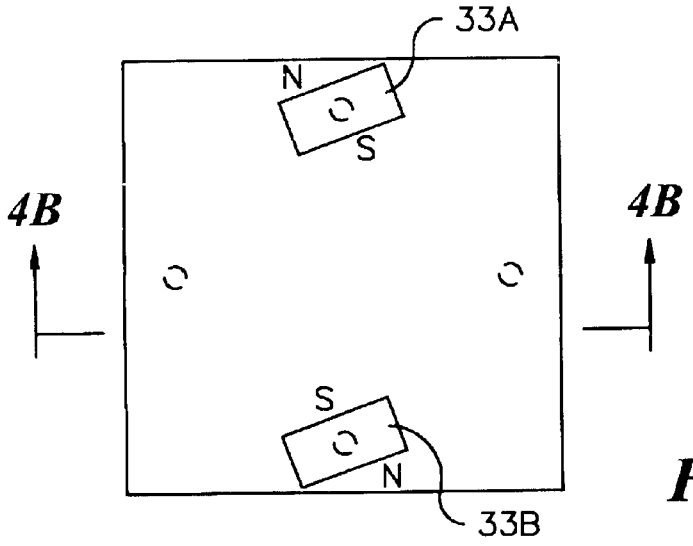
FIG. 4A is a bottom plan view of a preferred embodiment of a first playing piece showing a preferred configuration of player magnets.

The construction of the first playing pieces 8 are illustrated in FIGS. 4A and 4B. The first player magnets 33*a*, 33*b*, are similar to the first control magnets 28*a*, 28*b* but are thicker. The first player magnets 33*a*, 33*b* are installed on a non-magnetic first player base 32 of the first playing piece 8 in locations corresponding to the first control magnets 28*a*, 28*b* with the direction of magnetization of each first player magnet 33*a*, 33*b* being parallel to the first player base 32 and opposite in direction to the first control magnets 28*a*, 28*b*. Four half-spheres 31 operate similarly to those described as the half-spheres 31 for the control member 11 to minimize friction between the first player 8 and the top surface 102 of the panel 2. A first FIG. 35 is attached to a first housing 36, which is secured to the first player base 32. The first housing 36 is constructed of a non-magnetic material and preferably, is strong enough to withstand collisions with other playing pieces 8, 9 during the hockey game. A first hockey stick 37 is attached to the first housing 36 and to a hand of the first FIG. 35 so that a first horizontal portion 38 of the first hockey stick 37 is parallel to the first player base 32 and therefore, is also parallel to the surface 102 of the first panel 2. Preferably, the distance between the lower edge of the first hockey stick 37 and the first panel 2 is about 0.03 inches and the width of the horizontal portion 38 of the first hockey stick 37 is approximately the same as a height of the puck 10. As will be apparent to those skilled in the art, the first players 8, are not limited to being hockey players propelling a puck 10 with a hockey stick 37. The table game 100 may simulate any kind of a game in which the players are maneuvered around a playing field 1 and an object is propelled on a playing field 1, such as for example soccer, and still be within the spirit and scope of the invention.

Figure 4D:
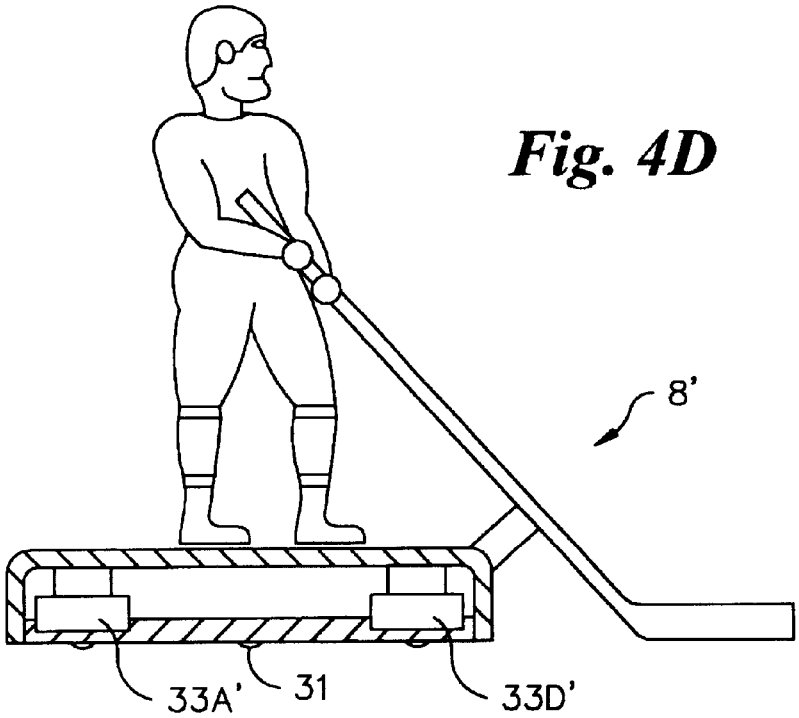
FIG. 4D is a sectional elevational view of the alternate embodiment of the first playing piece shown in FIG. 4C taken along the line 4D—4D.
Figure 4C:
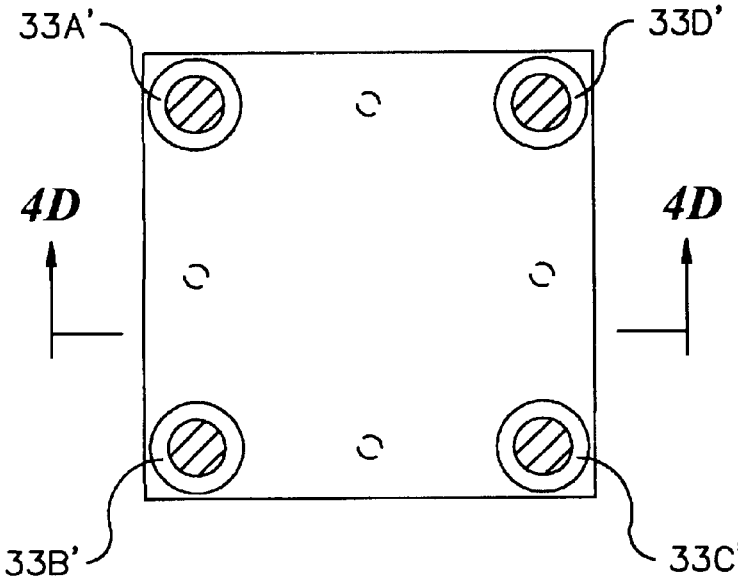
FIG. 4C is a bottom plan view of an alternate embodiment of a first playing piece showing an alternate configuration of first player magnets.

FIGS. 4C and 4D illustrate the construction of an alternate first playing piece 8' corresponding to the alternate control member 11' and having an alternate configuration of first player magnets 33*a*', 33*b*', 33*c*', 33*d*'. The alternate configuration of first player magnets 33*a*', 33*b*', 33*c*', 33*d*' is similar to the alternate first control magnets 28*a*', 28*b*', 28*c*' 28*d*' but are larger than the alternate first control magnets 28*a*', 28*b*', 28*c*' 28*d*'. The direction of magnetization of the alternate first player magnets 33*a*', 33*b*', 33*c*' and 33*d*' is perpendicular to the player base 32 and is in the same direction as the direction of magnetization of the alternate first control magnets 28*a*', 28*b*', 28*c*' 28*d*'.

Figure 5B:
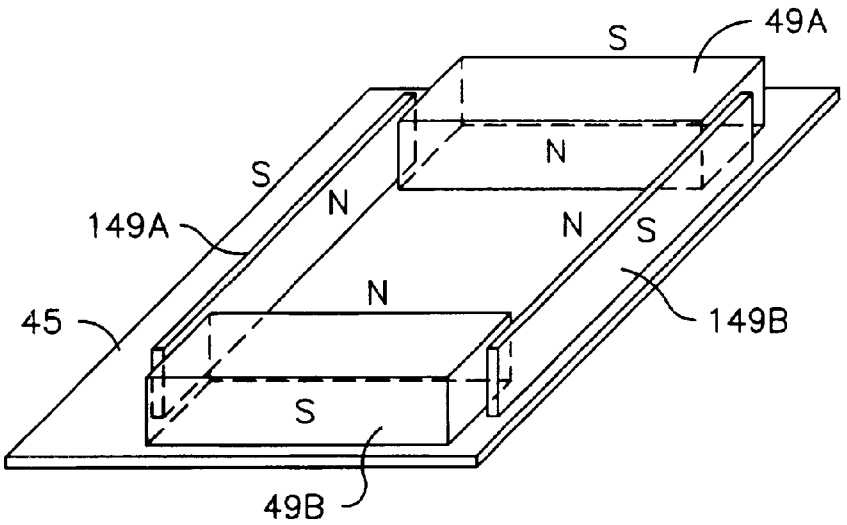
FIG. 5B is a perspective view of the preferred configuration of second control magnets shown in FIG. 5A.
Figure 5A:
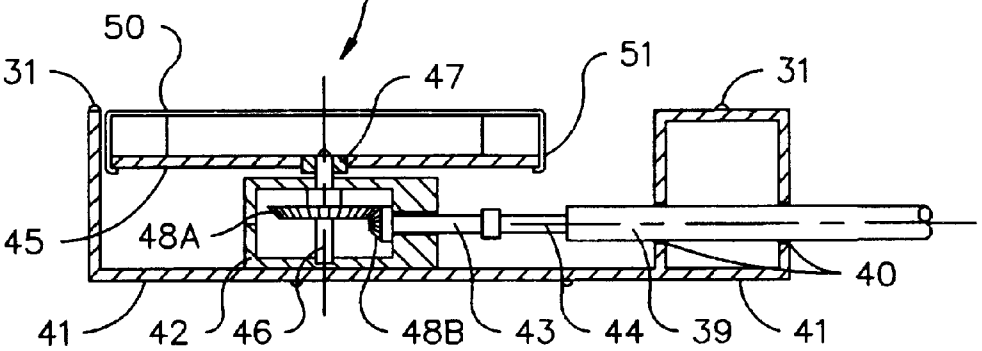
FIG. 5A is a sectional elevational view of a preferred embodiment of a second control member showing a preferred configuration of second control magnets.

FIGS. 5A and 5B illustrate the construction of a preferred embodiment of a second control member 12 used for maneuvering the second playing pieces 9 of the second team. A second control shaft 39 has a length approximately equal to the length of the sidewalls 7*a*, 7*c* of the table game 100 and is installed through second holes 40 on the vertical walls of a second housing 41. A second transmission 42 including a second output bevel gear 48*a* having a second output shaft 46 is attached to a horizontal part of the housing 41. A second input bevel gear 48*b* having a second input shaft 43 mates with the second output bevel gear 48*a* such that the axis of the second output shaft 46 is perpendicular to the axis of the second input shaft 43. The second input shaft 43 is connected to the second control shaft 39 by a second flexible shaft 44. An aluminum or polymeric second control plate 45 is connected to the second output shaft 46 with a second insert 47. The second control plate 45, the second insert 47, the second output shaft 46, and the second output bevel gear 48*a* (having a larger diameter than the second input bevel gear 48*b*) are fixedly connected together. Accordingly, a rotation of the second control shaft 39 around an axis of the second control shaft 39 rotates the second control plate 45 around an axis of the second control plate 45 perpendicular to the axis of the second control shaft 39. There are four half-spheres 31 on the top of the second housing 41.

As shown in FIG. 5B, a first pair of second control magnets 49*a*, 49*b* and a second pair of second control magnets 149*a*, 149*b* are arranged on the second control plate 45 so that the direction of magnetization of each magnet 49*a*, 49*b*; 149*a*, 149*b* is parallel to the second control plate 45 and the like poles of the magnets 49*a*, 49*b*; 149*a*, 149*b* are opposed to each other. The bar magnet pairs 49*a*, 49*b*; 149*a*, 149*b* are held to the second control plate 45 by a bracket 50. The bracket 50 is held in place by springs 51. The midpoint between the first pair of magnets 49*a*, 49*b* is offset from the second output shaft 46 to increase the torque for propelling the puck 10. If the magnitude of the magnetic intensity of the second pair of magnets 149*a*, 149*b* is approximately equal to the magnitude of the magnetic intensity of the first pair of magnets 49*a*, 49*b*, there is no need to offset the midpoint of the pair of bar magnets 49*a*, 49*b* from the second output shaft 46.

Figure 5D:
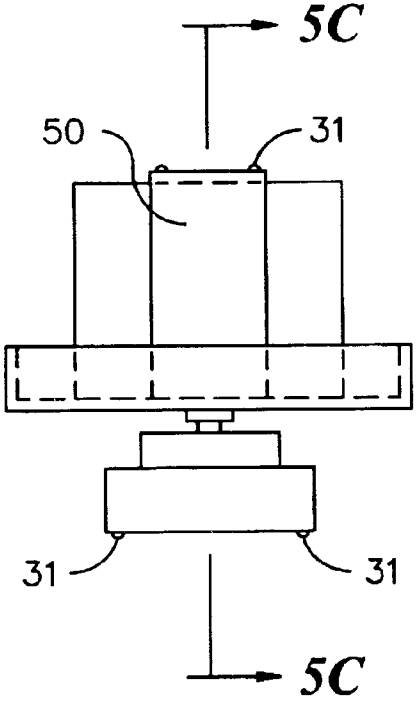
FIG. 5D is an elevational view of the alternate embodiment of the second control member.
Figure 5C:
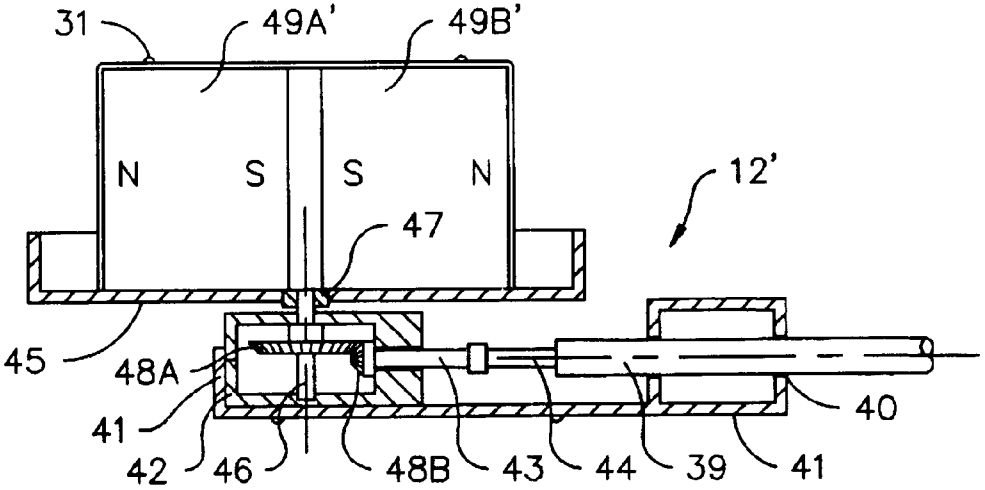
FIG. 5C is an elevational sectional view of an alternate embodiment of the second control member taken along the line 5C—5C of FIG. 5D, showing an alternate configuration of the second control magnets.

An alternative embodiment of the second control member 12' is shown in FIGS. 5C and 5D. The alternative embodiment of the second control member 12' is similar to the preferred embodiment of the second control member 11 except that there is only one pair of magnets 49*a*', 49*b*', arranged so that the south poles and the north poles of the pair of magnets 49*a*', 49*b*' oppose each other and the magnetization of the pair of magnets 49*a*', 49*b*' is parallel to the second control plate 45. In the alternate embodiment, each magnet 49*a*', 49*b*' has dimensions of approximately 1 inch×1 inch×1.5 inches. The dimensions of the second control plate 45 are approximately 1.5 inches greater than those of the magnets 49*a*', 49*b*' in order to prevent alternate second control members 12' from being attracted to each other. The second control plate 45 remains rigid during game play and is not effected by the weight of the magnets 49*a*', 49*b*'. There are four half-spheres 31 on a lower surface of the housing 41 and on the top of the housing 41.

Figure 6B:
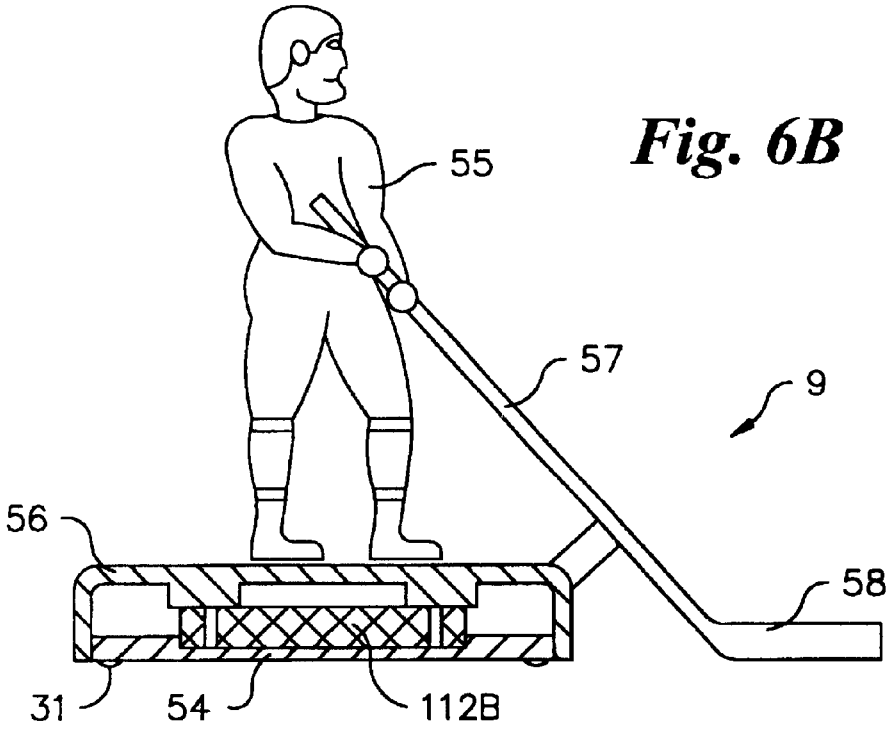
FIG. 6B is a sectional elevational view of the preferred embodiment of the second playing piece shown in FIG. 6A taken along the line 6B—6B.
Figure 6A:
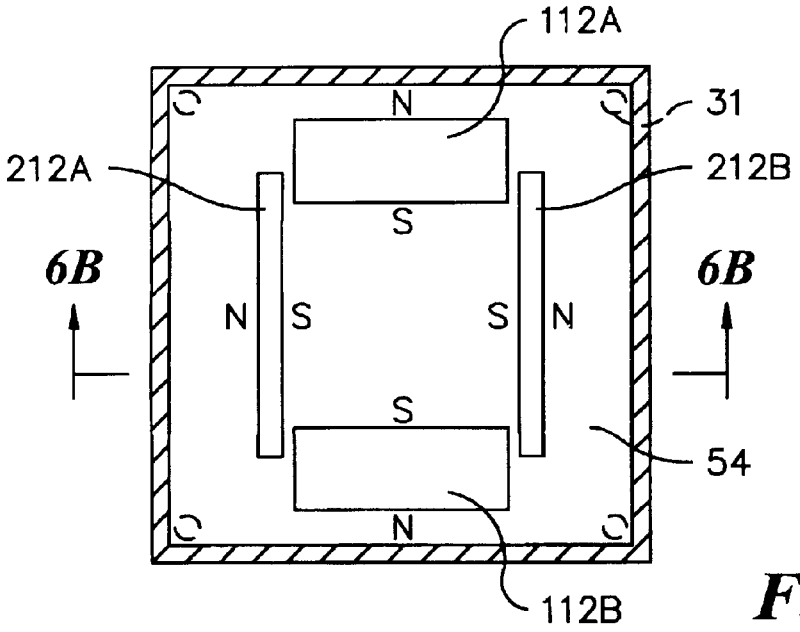
FIG. 6A is a bottom view of a preferred embodiment of a second playing piece showing a preferred configuration of second player magnets.

Referring now to FIGS. 6A and 6B there is shown a preferred embodiment of one of the second playing pieces 9 of the second team. A first pair of second player magnets 112*a*, 112*b* and a second pair of second player magnets 212*a*, 212*b* are installed on a base 54 of each playing piece 9. The first and the second pairs of second player magnets 112*a*, 112*b*; 212*a*, 212*b* are arranged to correspond to the location of the second control magnet pairs 49*a*, 49*b*; 149*a*; 149*b* of the second control member 12 with the orientation of the poles of the magnets 112*a*, 112*b*; 212*a*, 212*b* reversed with respect to the second control magnets 49*a*, 49*b*; 149*a*, 149*b* of the second control member 12. A second playing FIG. 55 is secured to a second housing 56. A second hockey stick 57 with a second horizontal part 58 is attached to the second housing 56 and further secured in the hands of the second playing FIG. 55. The construction of hockey stick 57 and the second playing FIG. 55 are the same as that of the hockey stick 37 and the first playing FIG. 35 respectively. The second base 54 and the second housing 56 are constructed from the same materials as the first base 32 and the first housing 36 of the first playing piece 8. There are four half-spheres 31 on the lower surface of the base 54.

Figure 6D:
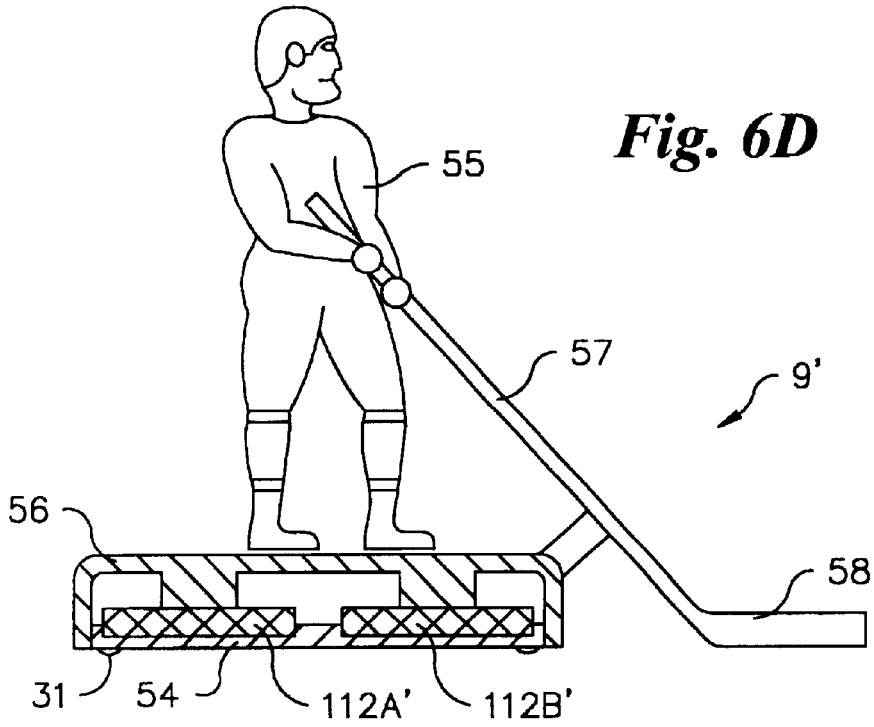
FIG. 6D is a sectional elevational view of the alternate embodiment of the second playing piece taken along the line 6D—6D.
Figure 6C:
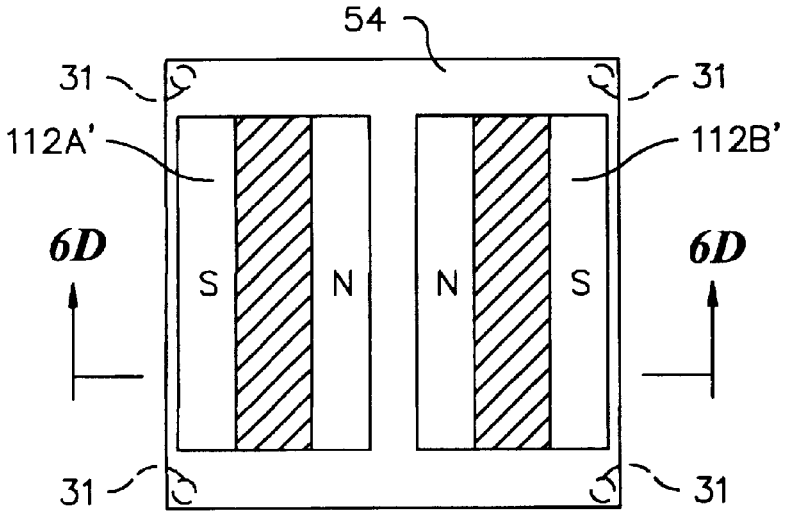
FIG. 6C is a bottom view of an alternate embodiment of the second playing piece showing an alternate configuration of the second player magnets.

An alternate embodiment of the second player 9' is shown in FIGS. 6C and 6D. Two alternate second player magnets 112*a*', 112*b*' are installed on a base 54. Each of the alternate second player magnets 112*a*', 112*b*' has the dimensions of approximately 0.2 inches×0.8 inches×1.5 inches. The direction of magnetization of the two alternate second player magnets 112*a*', 112*b*' is opposite to the direction of magnetization of the magnets 49*a*', 49*b*'.

Figure 7A:
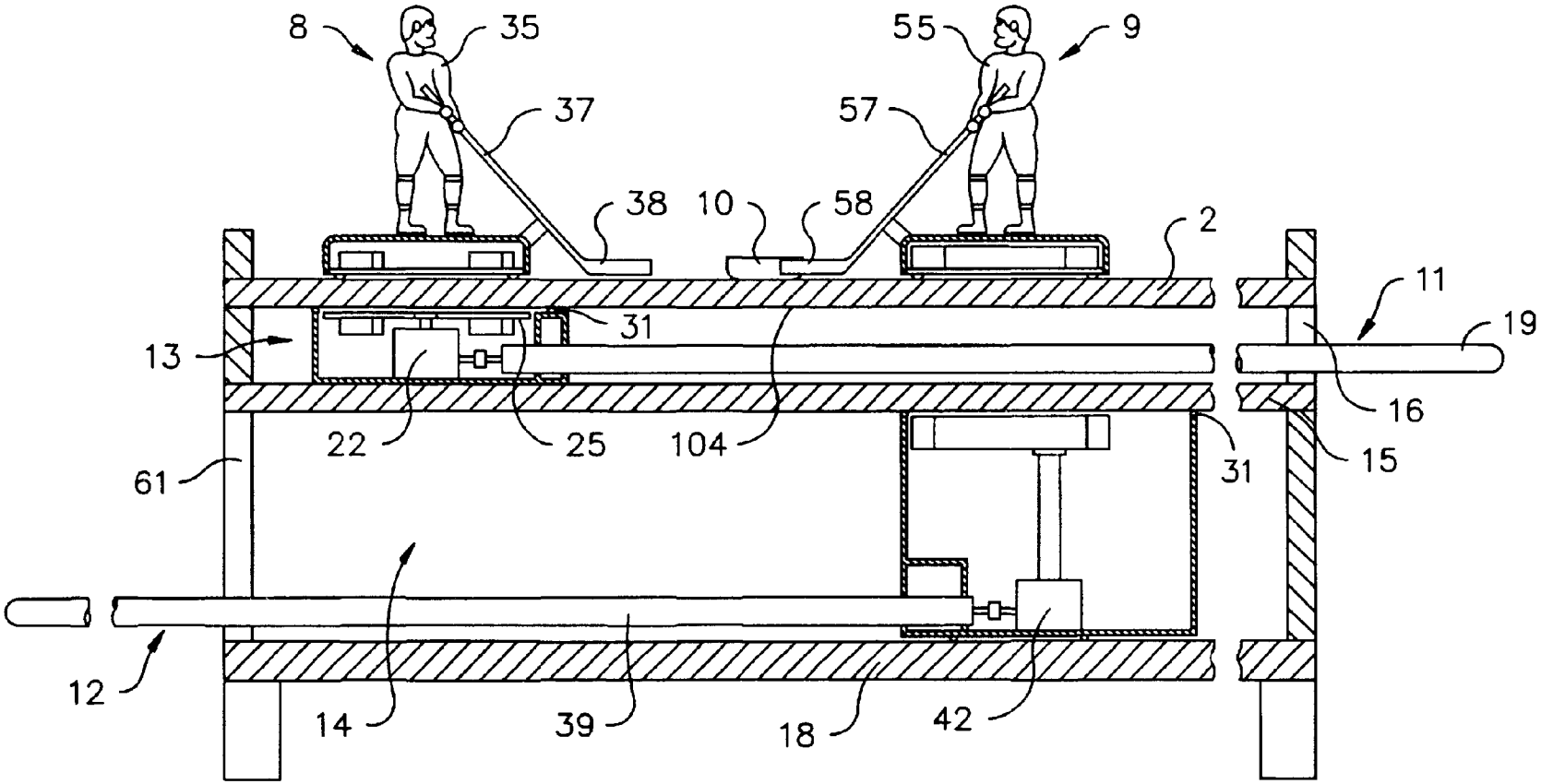
FIG. 7A is a sectional view of the first preferred embodiment of the table game showing a configuration of the first and the second playing pieces and the first and the second control members.

Referring now to FIG. 7A, the interaction of the preferred embodiments of the first and the second playing pieces 8, 9 and the first and second control members 11, 12 are described. First, the interaction of one of the first control members 11 and one of the first playing pieces 8 is described. The distance between the first control magnets 28*a*, 28*b* of the first control member 11 and the first player magnets 33*a*, 33*b* on the first base 32 of the first playing piece 8 is small because the first control magnets 28*a*, 28*b* of the first control member 11 and the first player magnets 33*a*, 33*b* of the first playing member 8 are separated only by the total thickness of the first base 32, the first panel 2, the first control plate 25, and the half-spheres 31. The design of the first control member 11, the first transmission 22 and the configuration of the first control magnets 28*a*, 28*b* produces the desired direction of the magnetic field while allowing the height of the first channel 13 to be minimized. This is important because it allows for independently controlling the second playing pieces 9 from the second channel 14. The direction of magnetization of the first control magnets 28*a*, 28*b* and the first player magnets 33*a*, 33*b* is parallel to the second control plate 45 and the panel 2. The configuration of the second control magnets 49*a*, 49*b*, 149*a*, 149*b* of the second control member 12 and the second player magnets 112*a*, 112*b*, 212*a*, 212*b* of the second playing piece 9 being different from the configuration of the first control magnets 28*a*, 28*b* and the first player magnets 33*a*, 33*b* allows for independent, competitive play and provides a stronger magnetic field to compensate for the greater distance between the second control member 12 and the second playing piece 9.

The interaction of the second playing pieces 9 and the respective second control members 12 is now described. The distance between the bottom of the second playing pieces 9 and the top of the second control members 12 is considerably greater than the distance between the first playing pieces 8 and the top of the first control members 9. This is because the first channel 13 and the second panel 15 are between the second playing pieces 9 and the respective second control members 12. Because of the greater distance, the second control magnets 49*a*, 49*b*, 149*a*, 149*b* and the second player magnets 112*a*, 112*b*, 212*a*, 212*b* are relatively heavy so that they can provide the needed stronger magnetic field.

The first player magnets 33*a*, 33*b* and the second player magnets and 112*a*, 112*b*, 212*a*, 212*b* that are installed respectively on the first and the second bases 32 and 54 are of minimum weight in order to decrease, as much as possible, frictional drag from movement of the first and the second playing pieces 8, 9. Accordingly, the first and the second playing pieces 8, 9 have excellent mobility and acceleration because the overall mass of the first and the second playing pieces 8, 9 is kept as low as possible.

Figure 7B:
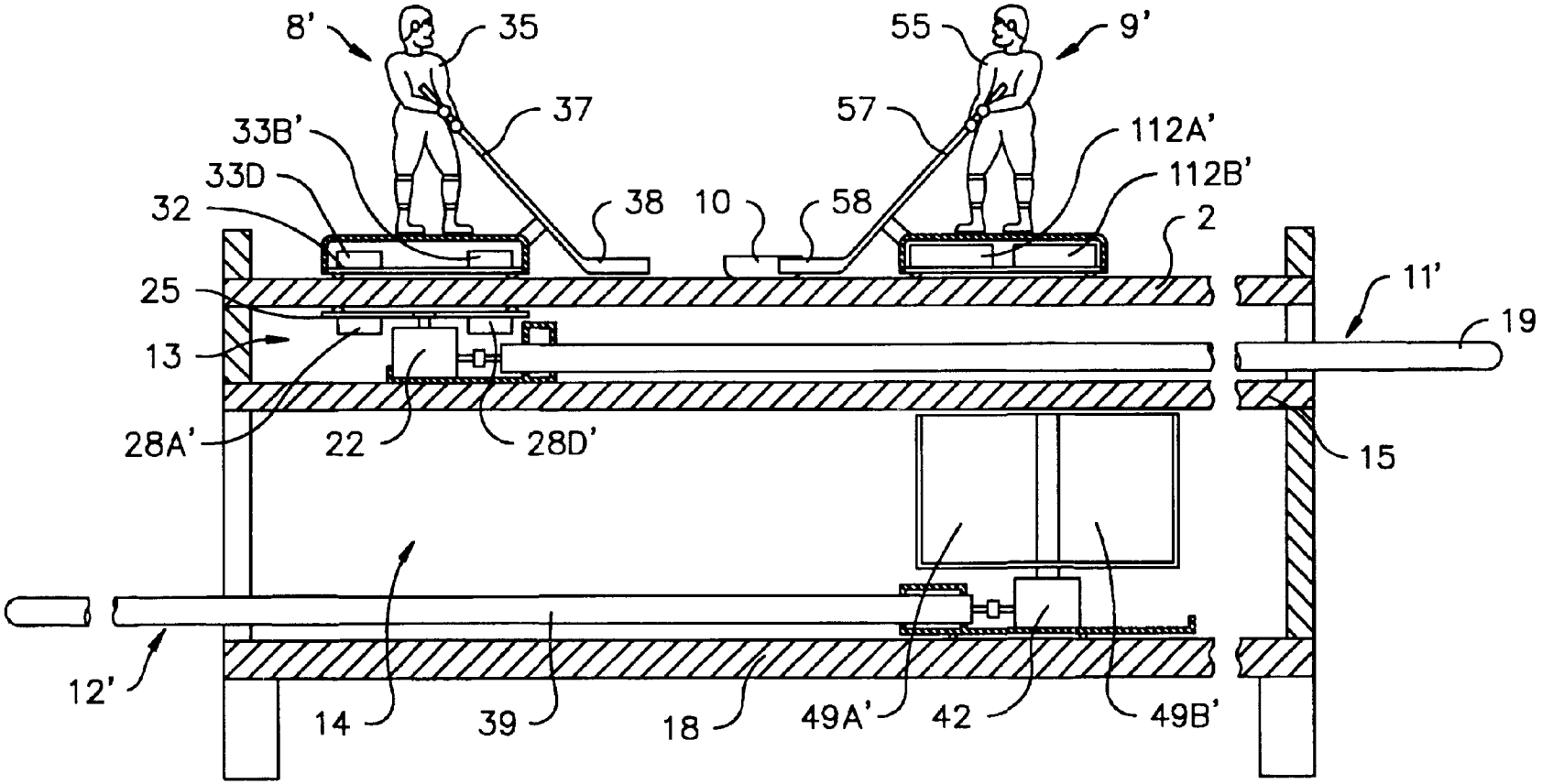
FIG. 7B is a sectional view of the first preferred embodiment of the table game showing a configuration of the alternate first and second playing pieces, and the alternate first and second control members.

FIG. 7B illustrates the interaction of the alternate embodiment of the first and the second playing pieces 8', 9' with the alternate embodiments of the first and the second control members 11', 12'.

Figure 7C:
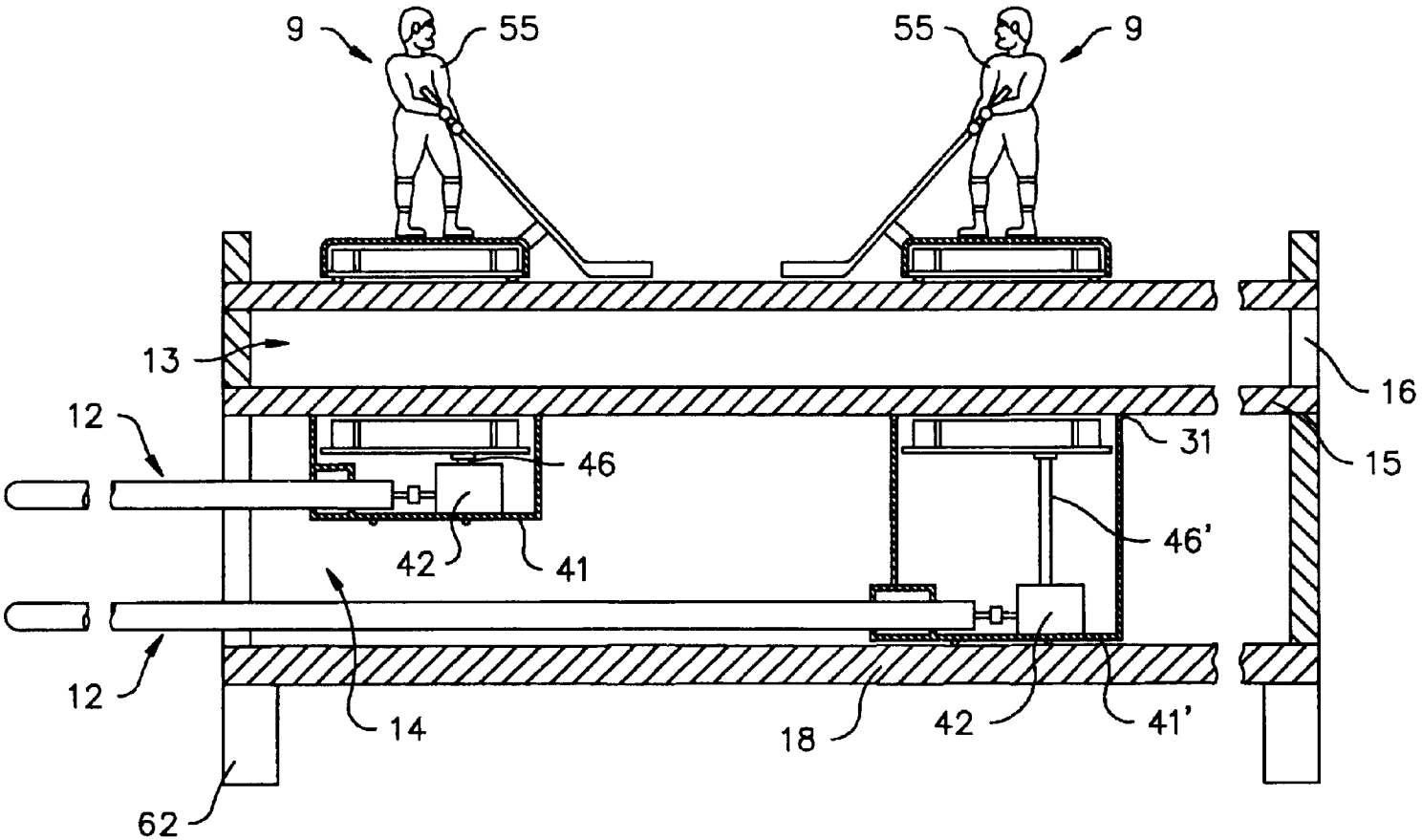
FIG. 7C is a sectional view of the first preferred embodiment of the table game showing a configuration of two second playing pieces, and two second control members located within the second channel.

FIG. 7C illustrates how the playing pieces 9 of the same team may be maneuvered simultaneously, without interference of the control members 12 within the same channel 14 by making the housings 41' and the output shafts 46' of the two control members 12 to be of different heights.

Figure 8:
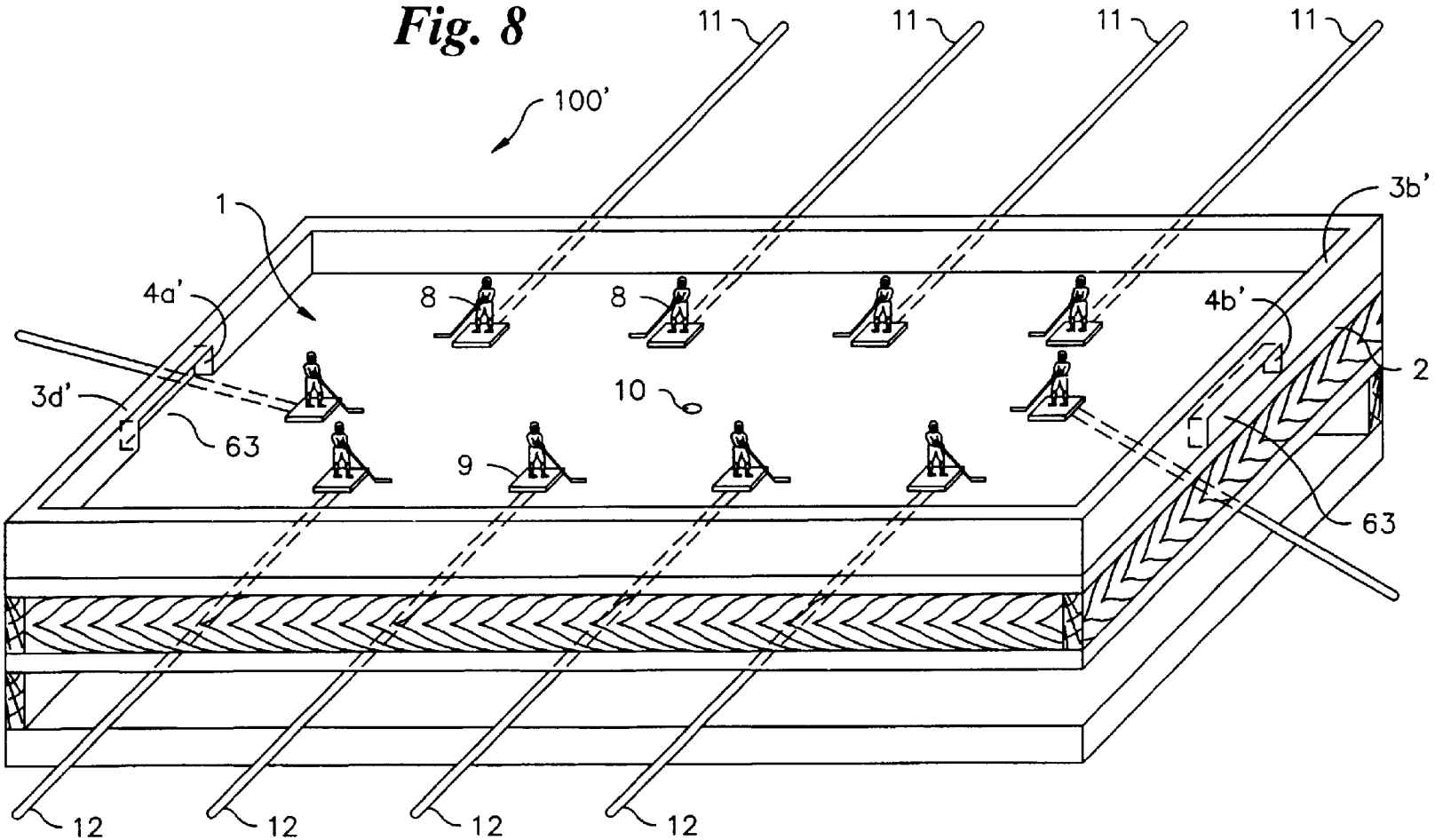
FIG. 8 is a perspective view of a second preferred embodiment of the table game with openings created in each endwall to form first and second goals.
Figure 9B:
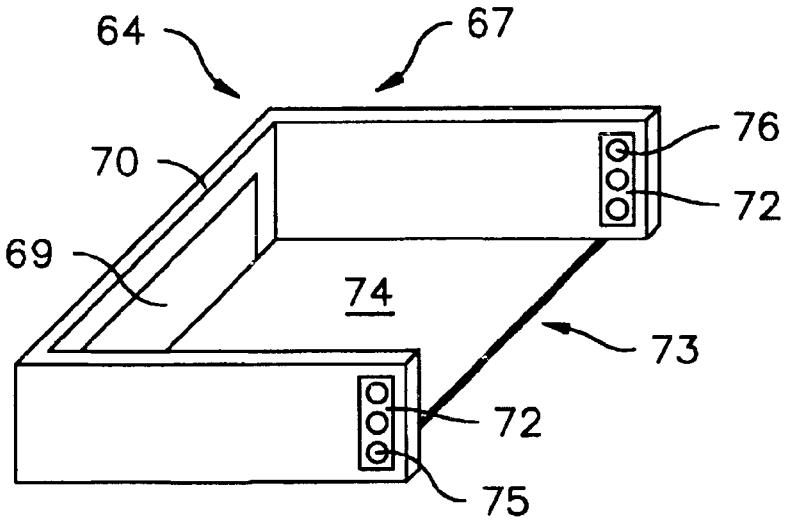
FIG. 9B is a perspective view of a chute used with the goal receptacle in the second preferred embodiment.
Figure 9A:
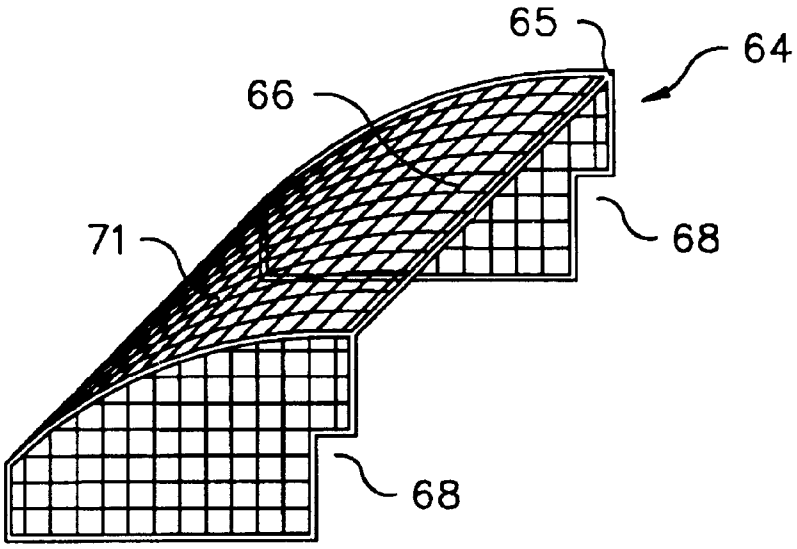
FIG. 9A is a perspective view of a goal receptacle used in the second preferred embodiment of the table game.

Referring now to FIGS. 8, 9A and 9B there is shown a second preferred embodiment of the table game 100' in which goals 4*a*', 4*b*' are formed by a goal receptacle 64 attached to the outside of an opening 63 in each endwall 3*b*', 3*d*'. Each goal receptacle 64 has a frame 65 constructed of a bent wire, a net 66, and a chute 67 that captures the puck 10. Spaces 68, which are not covered by the net 66, are formed on both sides of the frame 65. An opening 69 in a back side 70 of the chute 67 allows the puck 10 to pass through the chute 67. The net 66 does not cover a back side 71 of the frame 65, allowing the puck 10 to travel through the frame 65. The chute 67 is inserted into the frame 65 and attached to the frame 65 so that the opening 69 in the chute 67 coincides with the back side 71 of the frame 65. Vertical slots 72 in the chute 67 coincide with the spaces 68 when the chutes 67 are installed in the openings 63 of the endwalls 3*b*', 3*d*'. An open side of each chute 67 coincides with one of the openings 63 in the endwall 3*b*', 3*d*' (shown in FIG. 8). A cutout opening 73 in a panel 74 forming the bottom of the chute 67 aligns the chute 67 with the panel 2. Light emitters 75 and sensors 76 are placed along the slots 72. The emitters 75 and sensors 76, allow goals to be sensed when the puck 10 passes into one of the goals 4*a*', 4*b*'. The output of the sensors 76 may be registered on a score board (not shown). The score board can either be installed on one of the endwalls 3*b*', 3*d*' or kept as a separate entity.

Figure 10C:
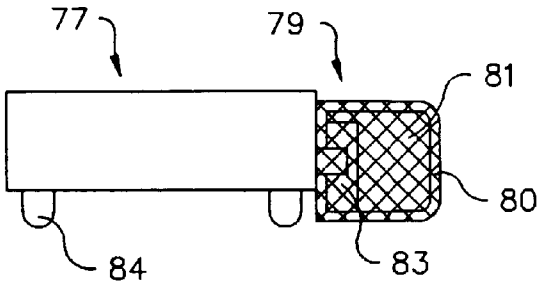
FIG. 10C is a side elevational view of the catching glove shown in FIG. 10A.
Figure 10B:
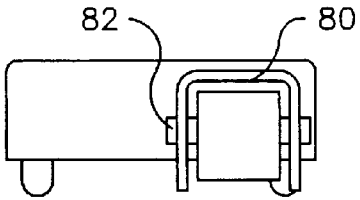
FIG. 10B is a front elevational view of the catching glove shown in FIG. 10A.
Figure 10A:
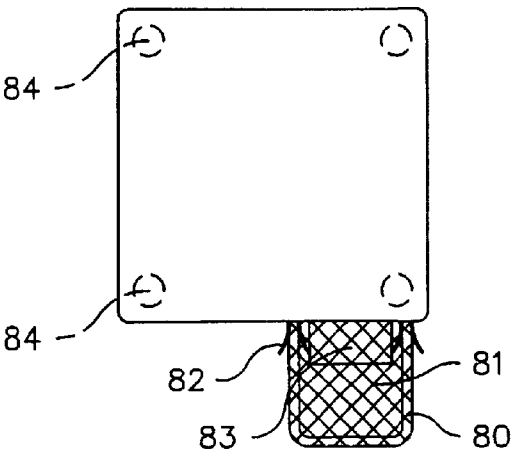
FIG. 10A is a plan view of a catching glove.

FIGS. 10A, 10B and 10C illustrate a glove 79 used by the first and the second playing pieces 8, 9 which are designated as goaltenders. For purposes of simplification, only a housing 77 of the goal tenders and the glove 79 are shown in FIGS. 10A, 10B and 10C. The gloves 79 for both the playing pieces 8, 9 are identical.

The glove 79 comprises a frame 80 and a net 81. The frame 80 is preferably constructed from a bent wire, made from any non-magnetic material that is capable of withstanding collisions resulting from normal play. The frame 80 is preferably covered by the net 81 made from a suitable threadlike material. The net 81 covers three sides of the upper portion of the frame 80. Two spring holders 82 are attached to the housing 77. The spring holders 82 are made of bronze but may be made from any non-magnetic material. The two spring holders 82 can be fabricated together with the housing 77. A damper 83, glued to the housing 77 and fabricated from any sponge-like material is used to prevent the puck 10 from being repelled back out of the glove 79. Four legs 84 are attached to the bottom of the housing 77. The legs 84 are higher (about 1.2:1) than the height of the puck 10 so that the puck 10 can pass under the goaltender.

The first and the second control members 85, 97 and the first and the second playing pieces 86, 98 for a third preferred embodiment of the table game 100" are shown in FIGS. 11–14. The third embodiment 100" is identical to the first preferred embodiment 100 and the second preferred embodiment 100' except that the first and the second control members 85, 97 do not have a transmission 22 and the first and the second playing pieces 86, 98 do not have a three dimensional FIG. 35 or a stick 37.

Figure 11B:
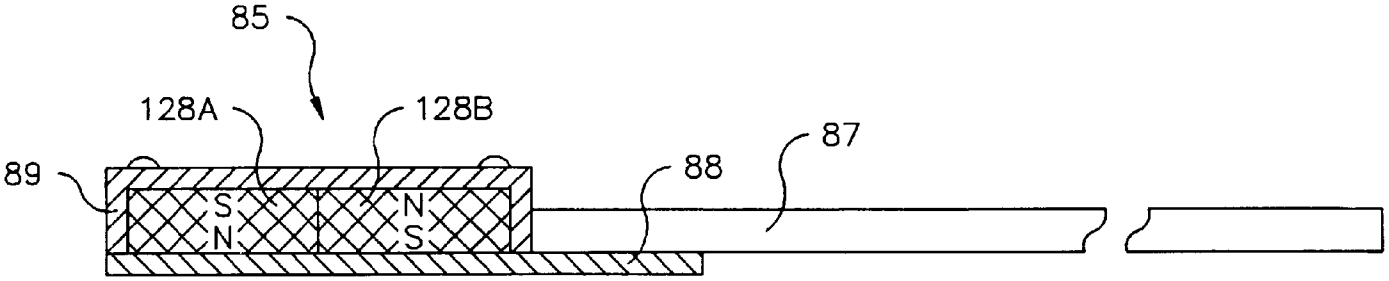
FIG. 11B is a sectional elevational view of the first control member shown in FIG. 11A taken along the line 11B—11B.
Figure 11A:
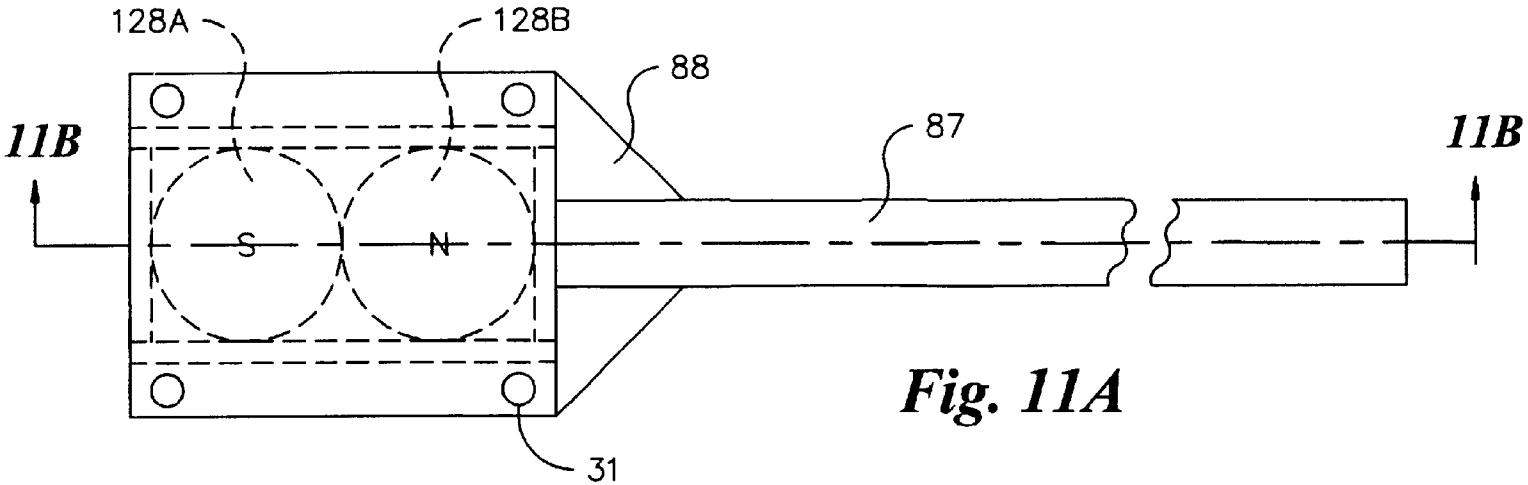
FIG. 11A is a plan view of a first control member for a third preferred embodiment of the table game.

The first control member 85 for the third preferred embodiment 100" is shown in FIGS. 11A and 11B. The first control member 85 includes a control shaft 87 attached to a plate 88 on which an assembly of two first control magnets 128*a*, 128*b* is installed. The direction of magnetization of the first control magnets 128*a*, 128*b* are perpendicular to the plate 88 and opposed to each other. A cover 89 fits tightly over the plate 88. Four half-spheres 31 are attached to a top of the cover 89. The first control member 85 controls the first playing piece 86 from the first channel 13 of the table game 100".

Figure 12A:
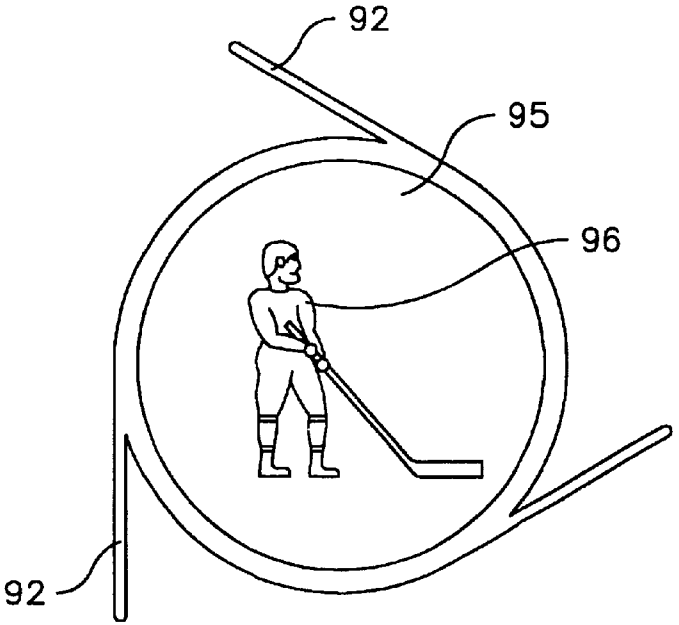
FIG. 12A is a top plan view of a first playing piece for the third preferred embodiment of the table game.
Figure 12B:
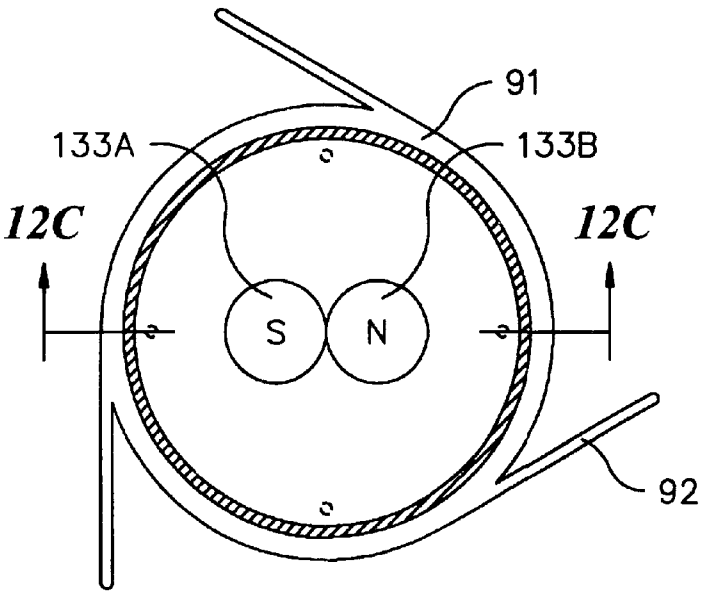
FIG. 12B is a sectional view of the first playing piece shown in FIG. 12C taken along line 12B—12B for the third preferred embodiment of the table game showing a preferred configuration of first player magnets.
Figure 12C:
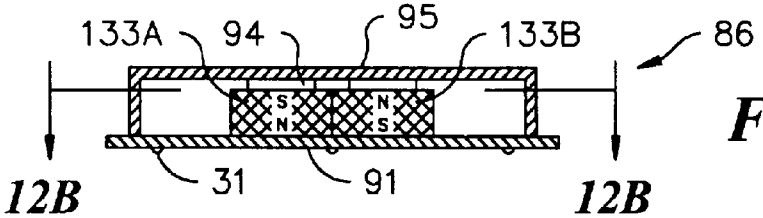
FIG. 12C is a sectional elevational view of the first playing piece for the third preferred embodiment of the table game shown in FIG. 12B taken along the line 12C—12C.

FIGS. 12A, 12B and 12C illustrate the first playing piece 86. An assembly of two first player magnets 133*a*, 133*b* is installed on a base 91 constructed from a non-magnetic material. The base 91 has three grippers 92 attached to a periphery of the base 91 at an angle of about 120 degrees to each other. Four half-spheres 31 are attached to the bottom of the base 91. Four spacers 94 secure the first player magnets 133*a*, 133*b* after a cover 95 is secured to the base 91. A picture 96 of a hockey player is on the face of the cover 95. The direction of the magnetization of the first player magnets 133*a*, 133*b* is in the same direction as the first control magnets 128*a*, 128*b* when the player is situated on the playing field 1.

Figure 12D:
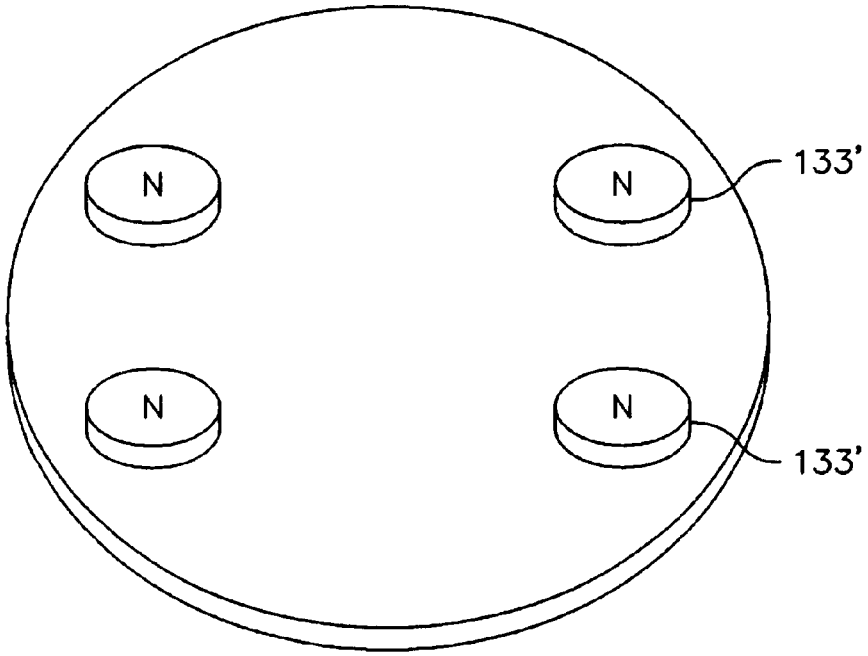
FIG. 12D is a perspective view of an alternate configuration of first player magnets mounted to a base of the first playing piece used in the third preferred embodiment.

FIG. 12D illustrates an alternate embodiment of the first player magnets 133' arranged on the base 91. The alternate player magnets 133' have a direction of magnetization oriented to be perpendicular to the base 91. The first control magnets 128' (not shown) are configured on the plate 88' (not shown) of each corresponding control member 85' (not shown) in the same locations as the player magnets 128', with the direction of magnetization in the magnets 133' in the same direction as the player magnets 128'. The player magnets 133' are generally smaller than the control magnets 128'.

Figure 13B:
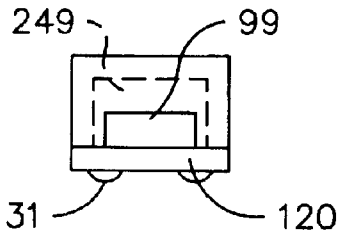
FIG. 13B is a sectional view of the second control member for the third preferred embodiment of the table game shown in FIG. 13A taken along the line 13B—13B.
Figure 13A:
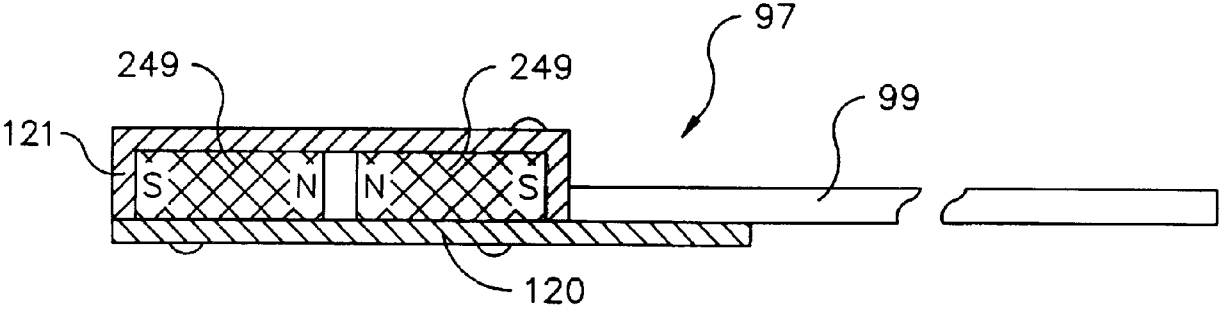
FIG. 13A is a sectional elevational view of a second control member for the third preferred embodiment of the table game.
Figure 13C:
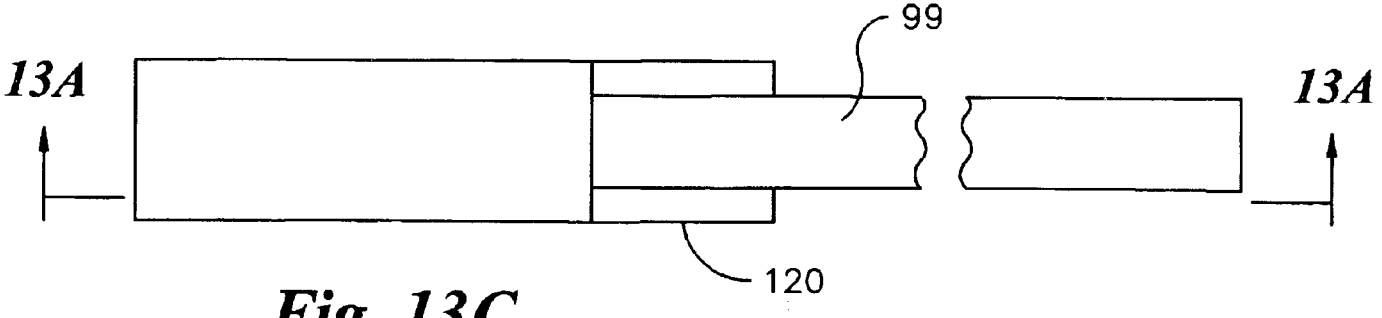
FIG. 13C is a plan view of the second control member for the third preferred embodiment of the table game.

FIGS. 13A and 13B illustrate the construction of the second control member 97 that controls the second playing piece 98 from the lower channel 14. A control shaft 99 is attached to a plate 120. Two second control magnets 249 are attached to the plate 120 with the aid of a bracket 121. A spring 122 holds the bracket 121.

Figure 14A:
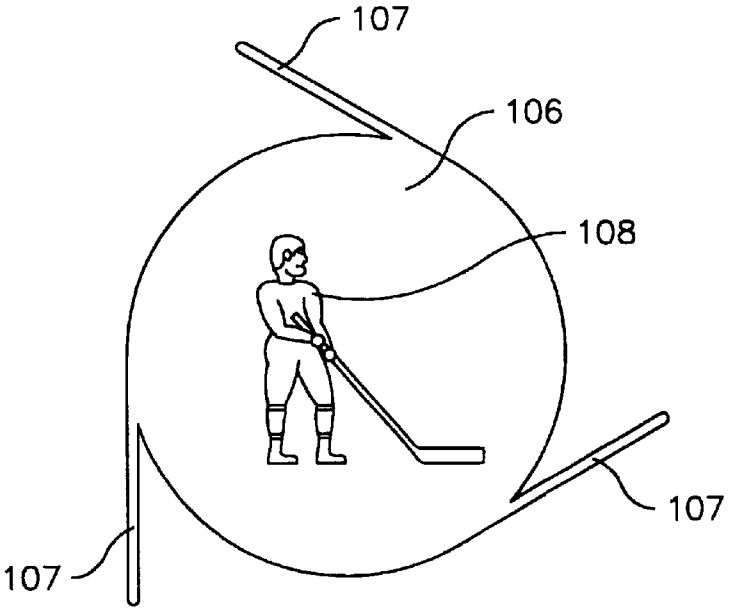
FIG. 14A is a top plan view of a second playing piece for the third preferred embodiment of the table game.
Figure 14B:
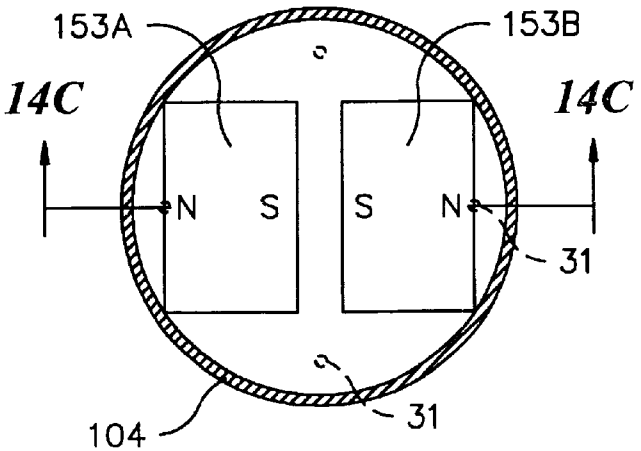
FIG. 14B is a sectional view of the second playing piece for the third preferred embodiment of the table game.
Figure 14C:
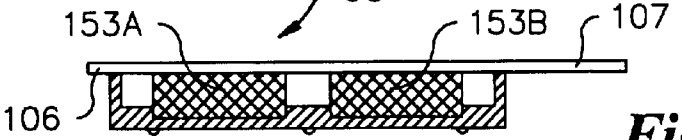
FIG. 14C is a sectional elevational view of the second playing piece shown in FIG. 14B taken along the line 14C—14C.

FIGS. 14A, 14B and 14C illustrate the second playing piece 98. Two second player magnets 153*a*, 153*b* are attached to a base 114. Four half-spheres 31 are on the bottom of the base 114. A cover 106 is secured to the base 114 and to the second player magnets 153*a*, 153*b*. The cover 106 is disk shaped and has three grippers 107, arranged at an angle of about 120 degrees to each other. The second playing piece 98 has a picture 108 which is preferably the same as the picture 96 on the first playing piece 86 except for a different color. The bases 91, 114 and the covers 95, 106 are constructed of non-magnetic materials.

Figure 15:
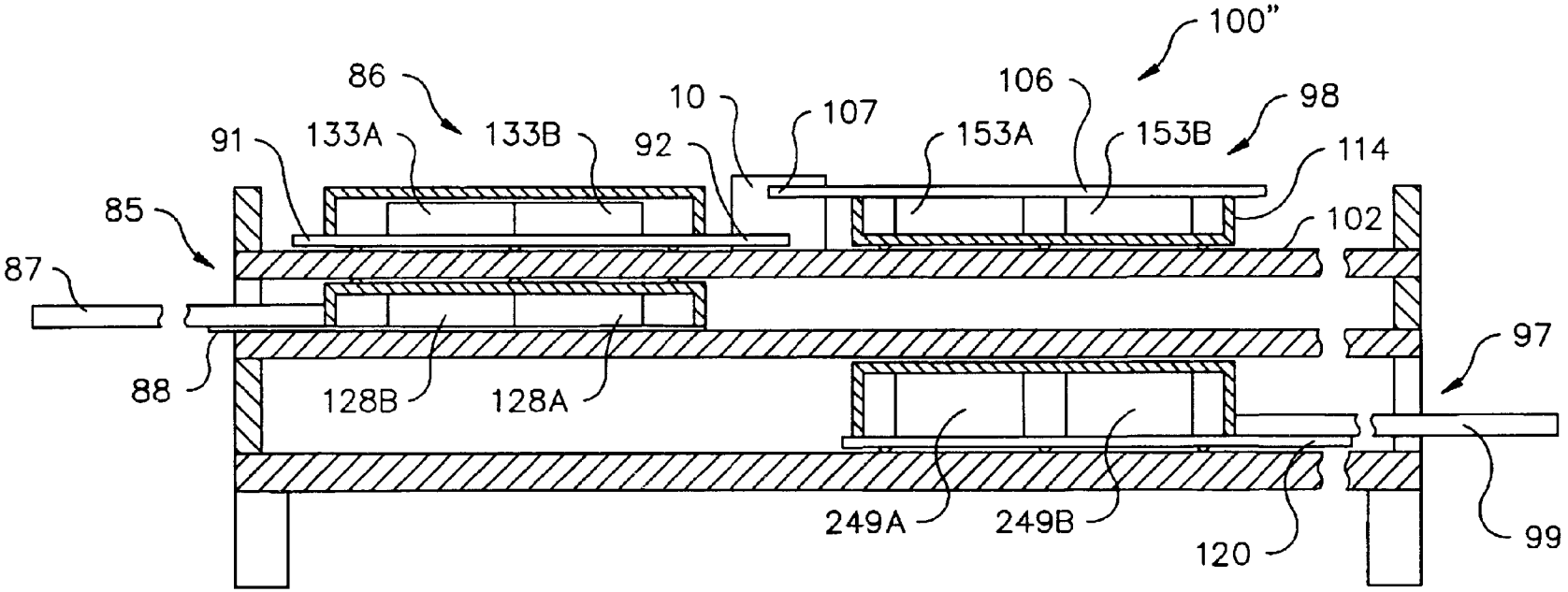
FIG. 15 is a sectional elevational view of the third preferred embodiment of the table game showing an arrangement of the first and the second playing pieces and the first and the second control members.

FIG. 15 illustrates the third embodiment 100" with the playing pieces 86, 98 from each team along with the corresponding control member 85, 97. The grippers 92 of the playing pieces 86 make contact with the lower half of the puck 10. The grippers 107 of the playing pieces 98 make contact with the upper part of the puck 10. All of the grippers 107 associated with one team are at a different height above the top surface 102 than those of the opposing team. The different heights of the grippers 92, 107 allow for both teams to independently act in the same space, vying for control of the playing puck 10. The puck 10 can be hit by the base 91, 114 of the playing pieces 86, 98 or by the grippers 92, 107.

The shape of the playing field 1 (not shown) for the third embodiment of the table game 100" is the same as the playing field 1 shown in FIG. 8 with the goals 4*a*, 4*b* located in the endwalls 3*b*, 3*d*. The dimensions of the playing field 1 are preferably approximately 3.5 feet×1.75 feet. The length of the control shafts 87, 99 are approximately equal to 2.6 feet. However, as would be apparent to those skilled in the at, the third embodiment could be larger or smaller than the aforementioned dimensions and still be within the spirit and scope of the invention.

In use as a hockey game, each team of hockey players may consist of 4–5 field-playing pieces 8, 9 along with a goalkeeper playing piece to defend each goal 4*a*, 4*b*. A control member 11, 12 is associated with each playing piece 8, 9. The control members 11, 12 allow for movement of the playing pieces 8, 9 in any direction. A player controls one of the teams from one of the sides of the table game 100 and the corresponding end (behind the goal) while an adversary player on the opposite side of the table game 100 controls the other team in similar fashion. Each team can, if desired, have two or even three players if the size of the table is appropriately large. The control members 11, 12 from each team do not interfere with each other, as they are within the separate channels 13, 14 beneath the playing field 1. A player can manipulate two control members 11 or 12 at any one moment—switching as needed to other control members 11 or 12.

Control members 11, 12 for each team are inserted into the appropriate channel 13, 14. The control members 11, 12 for each team are preferably color coded to match the playing pieces 8, 9 on that team. The first control members 11 occupy the first channel 13 (nearer to the playing field), while the second control members 12 are inserted in the second channel 14. The control members 11, 12 for each channel 13, 14 are physically different in that the second control members 12 on the lower channel 14, must be able to control the playing pieces 9 on the playing field 1 with the same magnetic pull as the first control members 11 on the upper channel 13. The playing pieces 8, 9 are placed on the playing field 1 so that they align with the control members 11, 12 below for maximum magnetic coupling. The playing pieces 8, 9 are moved in the desired direction by manipulation of the control members 11, 12 laterally, rotationally or in combination. The puck 10 can be propelled by either a translational motion of the playing piece or a revolving motion of the playing piece by rotation of the control shaft 19, 39. The degree of force in making the rotational movement determines the speed and force of the puck 10 as it is propelled forward. In the third embodiment 100", the playing piece 8, 9 is pushed against the puck 10. The puck 10 can be sent to another member of the team or shot directly toward one of the goals 4*a*, 4*b*. The idea is, of course, to get the puck 10 in the opposing goal.

The goalkeeper's job is to prevent the puck 10 from entering the goal 4*a*, 4*b*. Of course, the goal 4*a*, 4*b* can be and should be defended by the team players 8, 9 as well as the goalkeeper. However, the goalkeeper is the ultimate defense. A player placed at an end side 7*b*, 7*d* of the table game 100 maneuvers the goalkeeper. The goalkeeper is equipped with the hockey stick 37, 57 and glove 79 to stop the puck 10 from entering the goal 4*a*, 4*b*.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A table game comprising:

a generally planar panel having a top surface serving as a playing field;

a support structure supporting the panel, the support structure including a first channel below and adjacent to the panel and a second channel below and adjacent to the first channel;

at least one first playing piece and at least one second playing piece disposed on the playing field;

at least one first control member slidably disposed within the first channel of the support structure, the at least one first control member including a first control magnet assembly magnetically coupling the first control member to a first player magnet assembly disposed in the at least one first playing piece; and at least one second control member slidably disposed within the second channel of the support structure, the at least one second control member including a second control magnet assembly generating a significantly stronger magnetic field than the first magnetic assembly, the second control magnet assembly magnetically coupling the at least one second control member to a second player magnet assembly disposed in the at least one second playing piece, wherein a magnitude of the magnetic coupling between the first control magnet assembly and the second player magnet assembly is less than a magnitude of the magnetic coupling between the second control magnet assembly and the second player magnet assembly, and a magnitude of the magnetic coupling between the second control magnetic assembly and first player magnetic assembly is less than a magnitude of the magnetic coupling between the first control magnetic assembly and the first player magnetic assembly.

2. The table game according to claim 1, wherein the first and the second magnet assemblies are each mounted to a respective control plate each respective control plate being disposed generally parallel to the playing field and capable of continuous 360 degree rotation about a control axis which is generally perpendicular to the playing field, whereby the at least one first playing piece and the at least one second playing piece are caused to rotate around a longitudinal axis of a respective first playing piece or second playing piece in response to the rotation of the respective control plate.

3. The table game according to claim 2, wherein the first and the second control magnet assemblies each include at least one pair of spaced apart magnets, a direction of a magnetic intensity within each of the at least one pair of spaced apart magnets of the first and the second control magnet assemblies being generally parallel to the respective control plate, and wherein the first and the second player magnet assemblies are each mounted to a base plate which is generally parallel to the playing field, a direction of a magnetic intensity within each of the at least one pair of spaced apart magnets of the first and the second player magnet assemblies being generally parallel to the respective base plate.

4. The table game according to claim 2, wherein each of the at least one first and second control members further include a single control shaft by which each of the at least one first control members and each of the at least one second control members is moved wherein the rotation of each respective control plate is caused by a rotation about an axis of the respective control shaft.

5. The table game according to claim 4, wherein each of the first control members include a transmission for converting the rotation of the control shaft to the rotation of the control plate, wherein a portion of said transmission is disposed in a space between the at least one pair of spaced apart magnets.

6. A table game comprising:

a generally planar panel having a top surface serving as a playing field;

at least one first playing piece and at least one second playing piece disposed on the playing field;

at least one first control member disposed beneath the panel, the at least one first control member including a first control magnet assembly for magnetically coupling the at least one first control member to a first player magnet assembly in the at least one first playing piece, wherein the first control magnet assembly and the first player magnetic assembly each comprise at least one pair of spaced apart magnets, the spaced apart magnets having like poles opposing each other, the opposing poles on the first control magnet assembly being of an opposite polarity to the opposing poles of the first player magnet assembly; and at least one second control member disposed beneath the panel, the at least one second control member including a second control magnet assembly for magnetically coupling the at least one second control member to a respective second player magnet assembly in the at least one second playing piece, wherein the second control magnet assembly and the second player magnetic assembly each comprise at least one pair of spaced apart magnets, the spaced apart magnets having like poles opposing each other, the opposing poles on the second control magnet assembly being of an opposite polarity to the opposing poles of the second player magnet assembly.

7. The table game according to claim 6, wherein the first and second control magnet assemblies are mounted to a respective control plate, a direction of a magnetic intensity within each of the at least one spaced apart magnets of the first and the second control magnet assemblies being generally parallel to the respective control plate and wherein the first and the second player magnet assemblies are each mounted to a base plate and a direction of a magnetic intensity within each of the at least one spaced apart magnets of the first and the second magnet assemblies being generally parallel to the respective base plate.

8. The table game according to claim 7, wherein a direction of a magnetic intensity within the at least one pair of spaced apart magnets of the first control magnet assembly and of the first player magnet assembly is offset by about 45 degrees with respect to a line intersecting the centers of the at least one pair of spaced apart magnets.

9. The table game according to claim 7, wherein each control magnet assembly and each player magnet assembly comprises a first pair of the at least one pair of spaced apart magnets and a second pair of the at least one pair of spaced apart magnets, the direction of a magnetic intensity within the second pair of magnets being perpendicular to the direction of the magnetic intensity within the first pair of magnets.

10. The table game according to claim 7, wherein the at least one pair of spaced apart magnets of the first player magnet assemblies and the second player magnet assemblies are disposed such that each of the at least one first players and the at least one second players mutually repel each other.

11. A table game for moving at least one playing piece belonging to a first team and at least one playing piece belonging to a second team on a playing field, the table game comprising:

a generally planar first panel having a top surface including the playing field;

a support structure supporting the panel, the support structure including a first channel of a predetermined height below and adjacent to the panel; arid first and second control members slidably disposed within the first channel, each of the first and second control members including, (1) a first control magnet assembly magnetically coupling the first and second control members to a respective at least one first playing piece belonging to the first team, and (2) a shaft connected to the first control magnet assembly for maneuvering the first and second control members within the first channel, wherein the first control magnet assembly is contiguous with a bottom surface of the first panel such that the shaft of the first control member is connected to the first magnet assembly at a different distance from the panel than the shaft of the second control member, thereby enabling the first and second control members to be maneuvered within the first channel without mutual interference.

12. The table game according to claim 11, the support structure further including a second channel of a predetermined height, the second channel being located below the first channel and separated from the first channel by a second panel, wherein third and fourth control members are slidably disposed within the second channel, each of the third and fourth control members including; (1) a second control magnet assembly magnetically coupling the third and fourth control members to a respective at least one playing piece belonging to the second team, and (2) a shaft connected to the second control magnet assembly for maneuvering the third and fourth control members within the second channel, wherein the second control magnet assembly is contiguous with a bottom surface of the second panel such that the shaft of the third control member is connected to the second magnet assembly at a different distance from the panel than the shaft of the fourth control member, thereby enabling the third and fourth control members to be maneuvered within the second channel without mutual interference.

* * * * *